US010766743B2

(12) United States Patent
Shiraishi et al.

(10) Patent No.: US 10,766,743 B2
(45) Date of Patent: Sep. 8, 2020

(54) ELEVATOR DEVICE

(71) Applicant: MITSUBISHI ELECTRIC CORPORATION, Chiyoda-ku (JP)

(72) Inventors: Naohiro Shiraishi, Chiyoda-ku (JP); Ken Miyakawa, Chiyoda-ku (JP); Seiji Watanabe, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 689 days.

(21) Appl. No.: 15/304,791

(22) PCT Filed: May 14, 2014

(86) PCT No.: PCT/JP2014/062848
§ 371 (c)(1),
(2) Date: Oct. 17, 2016

(87) PCT Pub. No.: WO2015/173914
PCT Pub. Date: Nov. 19, 2015

(65) Prior Publication Data
US 2017/0121148 A1 May 4, 2017

(51) Int. Cl.
*B66B 5/04* (2006.01)
*B66B 5/18* (2006.01)
(Continued)

(52) U.S. Cl.
CPC ..... *B66B 5/044* (2013.01); *B66B 5/18* (2013.01); *B66B 5/22* (2013.01); *B66B 9/00* (2013.01)

(58) Field of Classification Search
CPC ..... B66B 5/044; B66B 5/046; B66B 5/042; B66B 5/25; B66B 5/24
See application file for complete search history.

(56) References Cited

U.S. PATENT DOCUMENTS 4,083,432 A * 4/1978 Lusti ..... B66B 5/04 187/373
4,565,264 A * 1/1986 Kunii ..... B66B 5/06 187/373
(Continued)

FOREIGN PATENT DOCUMENTS

JP 40-17620 Y1 6/1965
JP 57-7763 A 1/1982
(Continued)

OTHER PUBLICATIONS

International Search Report dated Jul. 29, 2014 in PCT/JP2014/062848, filed May 14, 2014.
(Continued)

*Primary Examiner* — Diem M Tran
(74) *Attorney, Agent, or Firm* — Xsensus LLP

(57) ABSTRACT

In an elevator device, a lower portion safety device is installed in a lower portion of a car, and an upper portion safety device is installed in an upper portion of the car. A lower portion pull-up lever that activates the lower portion safety device when pulled up by a speed governor rope is provided in the lower portion safety device. An upper portion pull-up lever that activates the upper portion safety device when pulled up by the speed governor rope is provided in the upper portion safety device. A lower portion elastic body is provided between the lower portion pull-up lever and the speed governor rope. An upper portion elastic body is provided between the upper portion pull-up lever and the speed governor rope.

4 Claims, 27 Drawing Sheets

(51) Int. Cl.
*B66B 5/22* (2006.01)
*B66B 9/00* (2006.01)

(56) References Cited

U.S. PATENT DOCUMENTS 6,003,636 A 12/1999 Yumura
8,550,217 B2 * 10/2013 Valjus ..... B66B 5/16
187/350

FOREIGN PATENT DOCUMENTS

JP 1-299179 A 12/1989
JP 9-328268 A 12/1997
WO 2008090601 A1 7/2008

OTHER PUBLICATIONS

Indian Office Action dated Sep. 9, 2019, issued in corresponding Indian Application No. 201647038396, 7 pages (with English Translation).

* cited by examiner

ELEVATOR DEVICE

TECHNICAL FIELD

This invention relates to an elevator device in which safety devices are installed respectively in upper and lower portions of a car.

BACKGROUND ART

In a conventional safety device for an elevator, an upper portion brake mechanism is housed in an upper frame of a car and a lower portion brake mechanism is housed in a lower frame of the car. A speed governor rope is joined to a lever of the upper portion brake mechanism. The lower portion brake mechanism is connected to the upper portion brake mechanism via a connecting rod. Thus, when the lever of the upper portion brake mechanism is operated by gripping the speed governor rope, a lever of the lower portion brake mechanism is also operated, whereby the upper portion brake mechanism and the lower portion brake mechanism are activated simultaneously. As a result, the upper portion brake mechanism and the lower portion brake mechanism can be reduced in size (see PTL 1, for example).

CITATION LIST

Patent Literature

[PTL 1] Japanese Patent Application Publication No. H1-299179

SUMMARY OF INVENTION

Technical Problem

In a conventional safety device for an elevator, such as that described above, the upper portion brake mechanism and the lower portion brake mechanism are activated simultaneously, and therefore the length of the connecting rod must be adjusted with a high degree of accuracy on site. Hence, installation work is difficult and inefficient.

This invention has been designed to solve the problem described above, and an object thereof is to obtain an elevator device with which a lower portion safety device and an upper portion safety device can be activated more reliably while improving on-site work efficiency.

Solution to Problem

An elevator device according to this invention includes an ascending/descending body, a lower portion safety device installed in a lower portion of the ascending/descending body, an upper portion safety device installed in an upper portion of the ascending/descending body, a speed governor rope that extends through a hoistway and performs a circulatory motion as the ascending/descending body ascends and descends, a lower portion pull-up lever that is provided in the lower portion safety device and activates the lower portion safety device when pulled up by the speed governor rope, an upper portion pull-up lever that is provided in the upper portion safety device and activates the upper portion safety device when pulled up by the speed governor rope, and a speed governor that monitors the ascending/descending body for travel at an excessive speed, and activates the lower portion safety device and the upper portion safety device by gripping the speed governor rope when a travel speed of the ascending/descending body reaches the excessive speed, wherein a lower portion elastic body is provided between the lower portion pull-up lever and the speed governor rope, and an upper portion elastic body is provided between the upper portion pull-up lever and the speed governor rope.

Further, an elevator device according to this invention includes an ascending/descending body, a lower portion safety device installed in a lower portion of the ascending/descending body, an upper portion safety device installed in an upper portion of the ascending/descending body, a speed governor rope that extends through a hoistway and performs a circulatory motion as the ascending/descending body ascends and descends, a lower portion pull-up lever that is provided in the lower portion safety device and activates the lower portion safety device when pulled up by the speed governor rope, an upper portion pull-up lever that is provided in the upper portion safety device and activates the upper portion safety device when pulled up by the speed governor rope, and a speed governor that monitors the ascending/descending body for travel at an excessive speed, and activates the lower portion safety device and the upper portion safety device by gripping the speed governor rope when a travel speed of the ascending/descending body reaches the excessive speed, wherein an elastic body is provided between the speed governor rope and either the lower portion pull-up lever or the upper portion pull-up lever, and a difference is provided in advance between a rotation stroke of the lower portion pull-up lever required to activate the lower portion safety device and a rotation stroke of the upper portion pull-up lever required to activate the upper portion safety device.

Advantageous Effects of Invention

With the elevator device according to this invention, the lower portion safety device and the upper portion safety device can be activated more reliably while improving on-site work efficiency.

DESCRIPTION OF EMBODIMENTS

Embodiments of this invention will be described below with reference to the drawings.

First Embodiment

Figure 1:
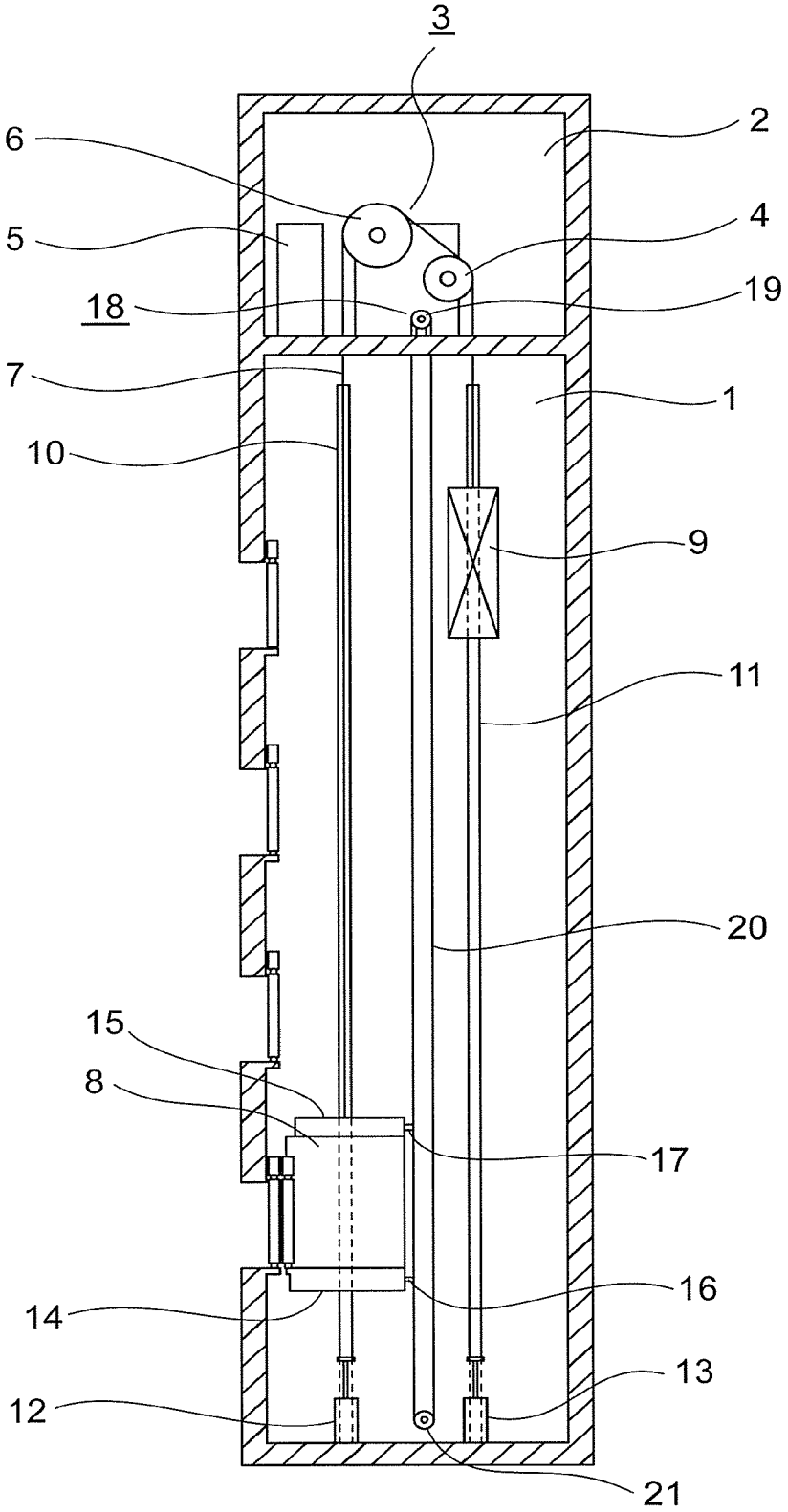
FIG. 1 is a view showing a configuration of an elevator device according to a first embodiment of this invention.

FIG. 1 is a view showing a configuration of an elevator device according to a first embodiment of this invention. In the drawing, a machine room 2 is provided in an upper portion of a hoistway 1. A hoisting machine (a driving device) 3, a deflector pulley 4, and a control device 5 are disposed in the machine room 2. The hoisting machine 3 includes a drive sheave 6, a hoisting machine motor (not shown) that rotates the drive sheave 6, and a hoisting machine brake (not shown) that applies a brake to rotation of the drive sheave 6.

A suspending body 7 is wound around the drive sheave 6 and the deflector pulley 4. A plurality of ropes or a plurality of belts are used as the suspending body 7. A car 8 serving as an ascending/descending body is connected to a first end portion of the suspending body 7. A counter weight 9 is connected to a second end portion of the suspending body 7.

The car 8 and the counter weight 9 are suspended by the suspending body 7 within the hoistway 1 so as to ascend and descend through the hoistway 1 in response to driving force from the hoisting machine 3. The control device 5 causes the car 8 to ascend and descend at a set speed by controlling the rotation of the hoisting machine 3.

A pair of car guide rails 10 for guiding the ascent and descent of the car 8 and a pair of counter weight guide rails 11 for guiding the ascent and descent of the counter weight 9 are disposed in the hoistway 1. A car buffer 12 and a counter weight buffer 13 are disposed in a bottom portion of the hoistway 1. The car buffer 12 reduces an impact generated when the car 8 collides with the bottom portion of the hoistway 1. Similarly, the counter weight buffer 13 reduces an impact generated when the counter weight 9 collides with the bottom portion of the hoistway 1.

A lower portion safety device 14 is installed in a lower portion of the car 8. An upper portion safety device 15 is installed in an upper portion of the car 8. The lower portion safety device 14 and the upper portion safety device 15 perform an emergency stop on the car 8 by gripping the car guide rails 10. In this example, the lower portion safety device 14 and the upper portion safety device 15 generate equal amounts of braking force.

The lower portion safety device 14 is provided with a lower portion pull-up level 16 by which the lower portion safety device 14 is activated. The upper portion safety device 15 is provided with an upper portion pull-up lever 17 by which the upper portion safety device 15 is activated.

A speed governor 18 that monitors the car 8 for travel at an excessive speed is provided in the machine room 2. The speed governor 18 includes a speed governor sheave 19, an excessive speed detection switch, a rope catch, and so on. A speed governor rope 20 is wound around the speed governor sheave 19.

The speed governor rope 20 extends through the hoistway 1 in loop form, and is connected to the lower portion pull-up lever 16 and the upper portion pull-up lever 17. In other words, the speed governor rope 20 is connected to the car 8 via the lower portion safety device 14 and the upper portion safety device 15.

Further, the speed governor rope 20 is wound around a tension pulley 21 disposed in a lower portion of the hoistway 1. As the car 8 ascends and descends, the speed governor rope 20 performs a circulatory motion, whereby the speed governor sheave 19 rotates at a rotation speed corresponding to the travel speed of the car 8.

The speed governor 18 determines mechanically whether or not the travel speed of the car 8 has reached an excessive speed. A first excessive speed Vos that is higher than a standard speed Vr and a second excessive speed Vtr that is higher than the first excessive speed are set as detected excessive speeds.

When the travel speed of the car 8 reaches the first excessive speed Vos, the excessive speed detection switch is operated. As a result, a power feed supplied to the hoisting machine 3 is interrupted, whereby the car 8 comes to an emergency stop.

When a descent speed of the car 8 reaches the second excessive speed Vtr, the rope catch grips the speed governor rope 20 so as to halt circulation of the speed governor rope 20. Accordingly, the lower portion pull-up lever 16 and the upper portion pull-up lever 17 are pulled up such that the lower portion safety device 14 and the upper portion safety device 15 are activated, and as a result, the car 8 comes to an emergency stop.

Note that in FIG. 1, for simplicity, the speed governor 18, the speed governor rope 20, and the tension pulley 21 are disposed behind the car 8 in a front-rear direction of the car 8, but in actuality, the speed governor rope 20 is disposed so as to extend directly alongside the car 8.

Figure 2:
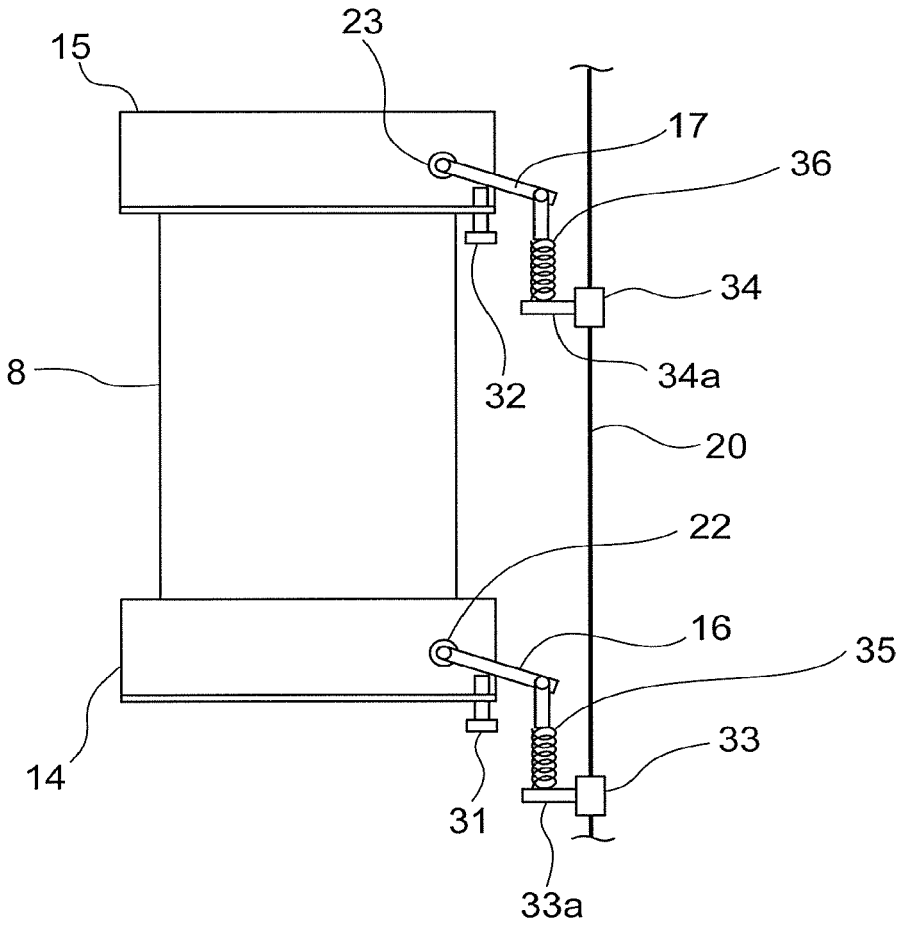
FIG. 2 is an enlarged front view of a car shown in FIG. 1.

FIG. 2 is an enlarged front view of the car 8 shown in FIG. 1. The lower portion pull-up lever 16 is capable of rotating about a lower portion pull-up lever shaft 22. The lower portion safety device 14 is activated by rotating the lower portion pull-up lever 16 in a counterclockwise direction of FIG. 2 (an activation direction). The upper portion pull-up lever 17 is capable of rotating about an upper portion pull-up lever shaft 23. The upper portion safety device 15 is activated by rotating the upper portion pull-up lever 17 in the counterclockwise direction of FIG. 2 (the activation direction).

A lower portion stopper bolt 31 is attached to the lower portion of the car 8 as a lower portion stopper that restricts rotation of the lower portion pull-up lever 16 in an opposite direction (a clockwise direction in FIG. 2) to the activation direction. An upper portion stopper bolt 32 is attached to an upper portion of the car 8 as an upper portion stopper that restricts rotation of the upper portion pull-up lever 17 in an opposite direction (the clockwise direction in FIG. 2) to the activation direction.

A lower portion rope fixing member (a block) 33 and an upper portion rope fixing member (a block) 34 are fixed to the speed governor rope 20. The upper portion rope fixing member 34 is fixed to the speed governor rope 20 above the lower portion rope fixing member 33.

A horizontally projecting lower portion support arm 33*a* is provided on the lower portion rope fixing member 33. A horizontally projecting upper portion support arm 34*a* is provided on the upper portion rope fixing member 34.

A lower portion elastic body 35 is provided between the lower portion support arm 33*a* and the lower portion pull-up lever 16 to be capable of expanding and contracting in a vertical direction. The lower portion pull-up lever 16 is connected to the speed governor rope 20 via the lower portion elastic body 35 and the lower portion rope fixing member 33.

An upper portion elastic body 36 is provided between the upper portion support arm 34*a* and the upper portion pull-up lever 17 to be capable of expanding and contracting in the vertical direction. The upper portion pull-up lever 17 is connected to the speed governor rope 20 via the upper portion elastic body 36 and the upper portion rope fixing member 34.

The lower portion elastic body 35 and the upper portion elastic body 36 are capable of elastically deforming in the vertical direction. Further, springs such as coil springs, for example, are used as the lower portion elastic body 35 and the upper portion elastic body 36.

Figure 3:
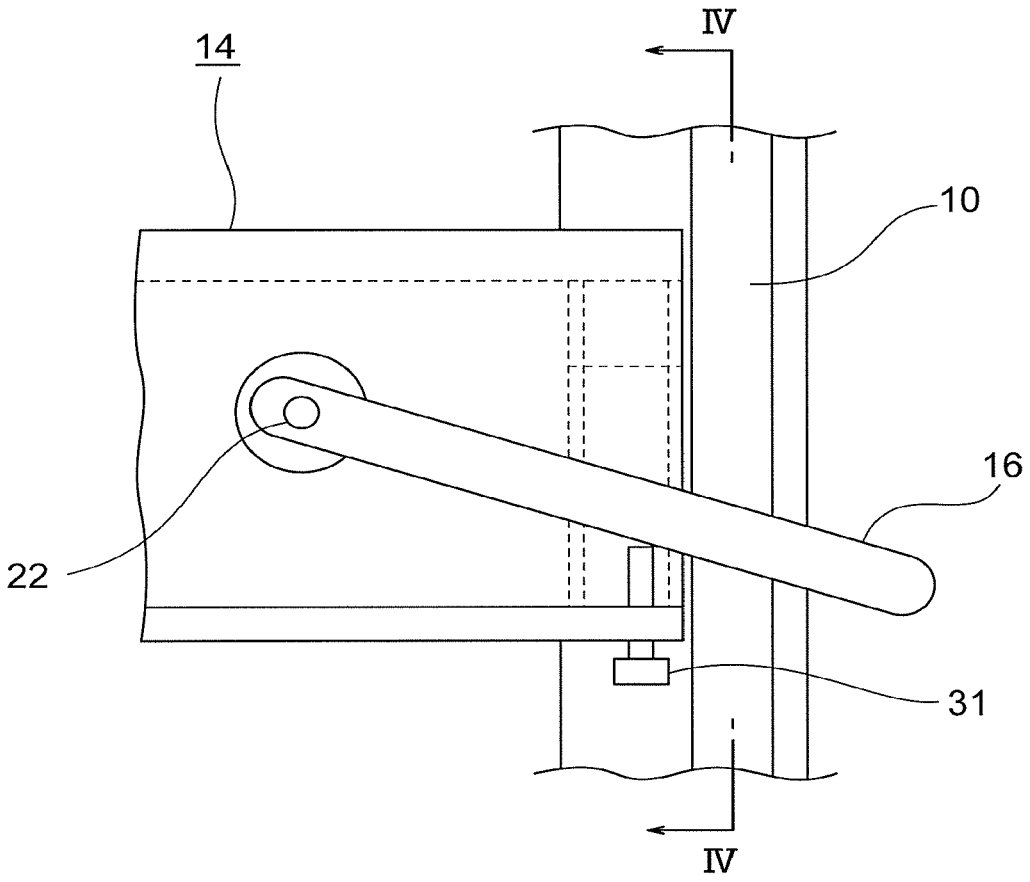
FIG. 3 is an enlarged front view showing main parts of a lower portion safety device of FIG. 1.
Figure 4:
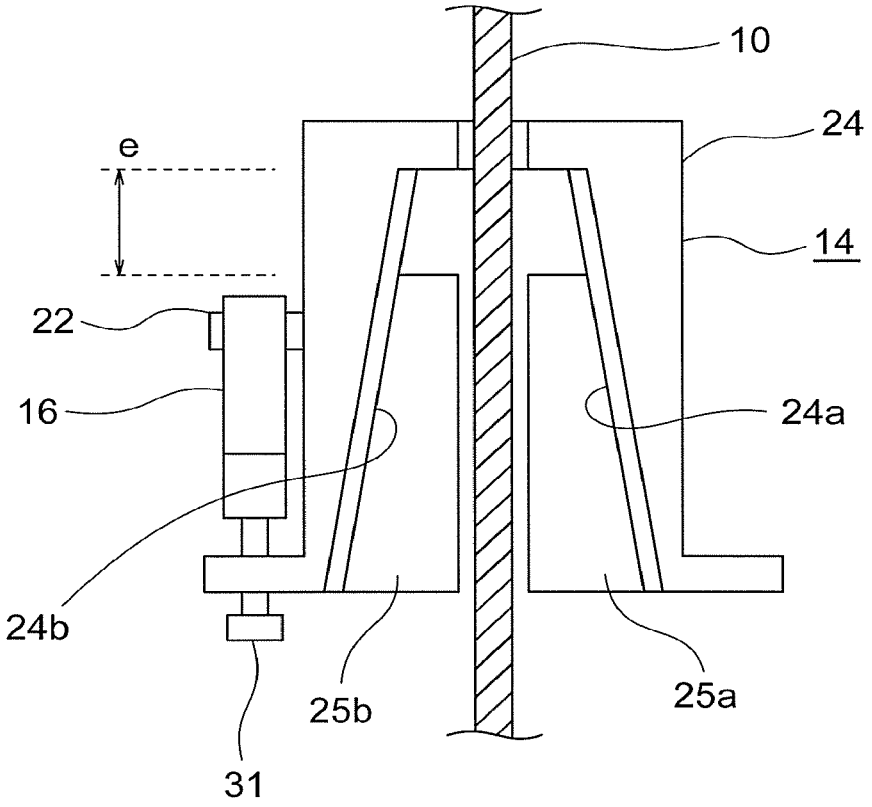
FIG. 4 is a sectional view taken along an IV-IV line in FIG. 3.

FIG. 3 is an enlarged front view showing main parts of the lower portion safety device 14 of FIG. 1, and FIG. 4 is a sectional view taken along an IV-IV line in FIG. 3. The lower portion safety device 14 includes a guide body 24 on which a pair of tapered guide surfaces 24*a*, 24*b* are formed, and a pair of wedges 25*a*, 25*b* disposed inside the guide body 24. The wedges 25*a*, 25*b* slide along the guide surfaces 24*a*, 24*b* in conjunction with the rotation of the lower portion pull-up lever 16.

Figure 5:
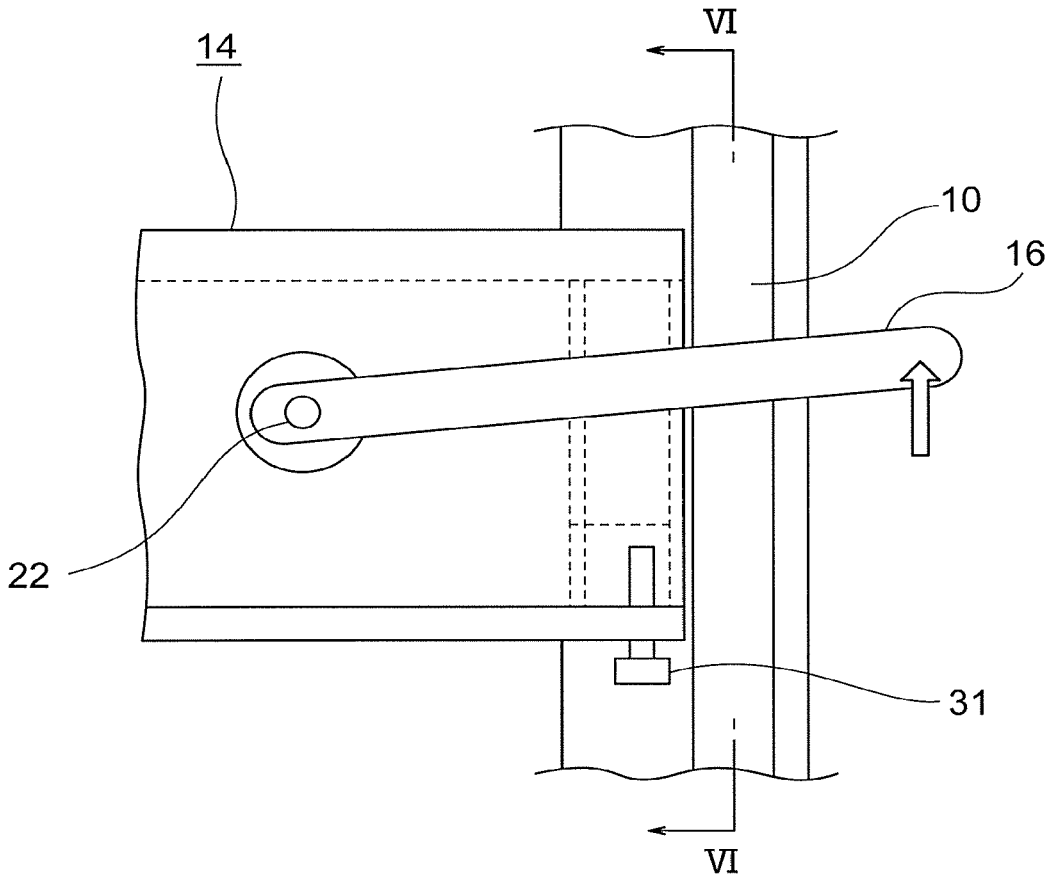
FIG. 5 is a front view showing a condition in which the lower portion safety device of FIG. 3 is activated.
Figure 6:
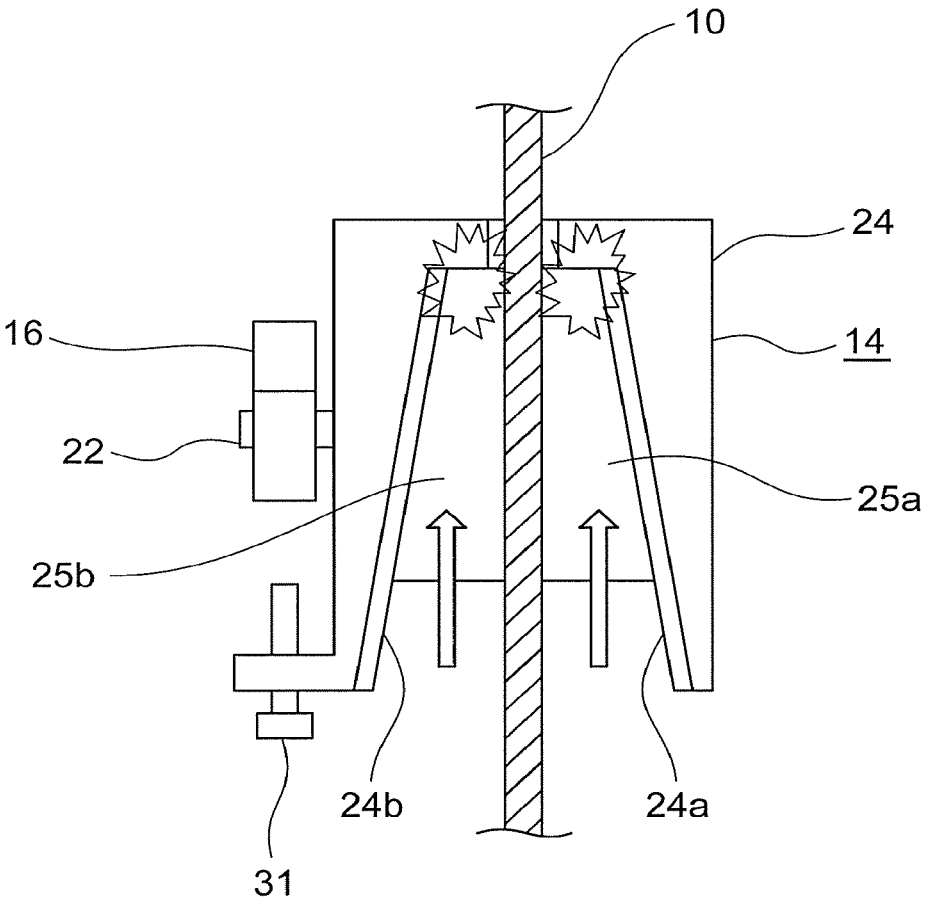
FIG. 6 is a sectional view taken along a VI-VI line in FIG. 5.

FIG. 5 is a front view showing a condition in which the lower portion safety device 14 of FIG. 3 is activated, and FIG. 6 is a sectional view taken along a VI-VI line in FIG. 5. When the lower portion pull-up lever 16 is pulled up relative to the car 8 so as to rotate in the counterclockwise direction of FIG. 3, the wedges 25*a*, 25*b* move in an upward direction in conjunction therewith. Accordingly, the wedges 25*a*, 25*b* become wedged between the guide body 24 and the car guide rails 10. As a result, braking force is generated such that the car 8 comes to a stop.

Normally, the wedges 25*a*, 25*b* are in lowered positions such than an intermediate portion of the lower portion pull-up lever 16 rests on an upper end portion of the lower portion stopper bolt 31. At this time, an ascent distance e (FIG. 4) required for the wedges 25*a*, 25*b* to become completely wedged is determined by adjusting a vertical direction position of the lower portion stopper bolt 31. When the wedges 25*a*, 25*b* ascend by the ascent distance e, the wedges 25*a*, 25*b* become completely wedged so as to be incapable of further movement, and therefore the lower portion pull-up lever 16 likewise cannot be rotated any further in a pull-up direction from the current position thereof (an activation position).

The upper portion safety device 15 is configured and operated similarly to the lower portion safety device 14, and is likewise provided with the guide body 24 and the wedges 25*a*, 25*b*.

The lower portion elastic body 35 and the upper portion elastic body 36 are sufficiently rigid to withstand a force for pulling up the lower portion pull-up lever 16 and the upper portion pull-up lever 17, and do not therefore deform elastically in response to a force for wedging the wedges 25*a*, 25*b* completely between the guide body 24 and the car guide rails 10 in order to activate the lower portion safety device 14 and the upper portion safety device 15.

In a condition where only one of the lower portion safety device 14 and the upper portion safety device 15 is activated when the car 8 falls, however, the lower portion elastic body 35 and the upper portion elastic body 36 deform elastically in response to a force for causing the car 8 to fall further relative to the speed governor rope 20.

In this elevator device, the lower portion elastic body 35 is interposed between the lower portion pull-up lever 16 and the speed governor rope 20, and the upper portion elastic body 36 is interposed between the upper portion pull-up lever 17 and the speed governor rope 20. Therefore, when a deviation occurs between respective activation timings of the lower portion safety device 14 and the upper portion safety device 15, either the lower portion elastic body 35 or the upper portion elastic body 36 contracts, with the result that both safety devices 14, 15 can be activated more reliably.

More specifically, if the lever that rotates to the activation position first, among the pull-up levers 16, 17, is set as a leading lever and the other lever is set as a following lever, when the car 8 attempts to fall further relative to the stopped speed governor rope 20 after the leading lever has rotated to the activation position, the lower portion elastic body 35 or the upper portion elastic body 36 connected to the leading lever contracts such that the following lever rotates to the activation position.

Hence, there is no need to make minute adjustments within a deformable range of the elastic bodies 35, 36 on site while installing the elevator device so that the lower portion safety device 14 and the upper portion safety device 15 are perfectly synchronized, and as a result, an improvement in on-site work efficiency can be achieved. Moreover, the lower portion safety device 14 and the upper portion safety device 15 can be activated more reliably.

Further, an identical component can be used for both the lower portion safety device 14 and the upper portion safety device 15.

Furthermore, the lower portion pull-up lever 16 is connected to the speed governor rope 20 via the lower portion elastic body 35 and the lower portion rope fixing member 33, while the upper portion pull-up lever 17 is connected to the speed governor rope 20 via the upper portion elastic body 36 and the upper portion rope fixing member 34, and therefore an identical configuration can be applied to products in which a distance between the lower portion safety device 14 and the upper portion safety device 15 varies (i.e. design modifications are not required).

Second Embodiment

Figure 7:
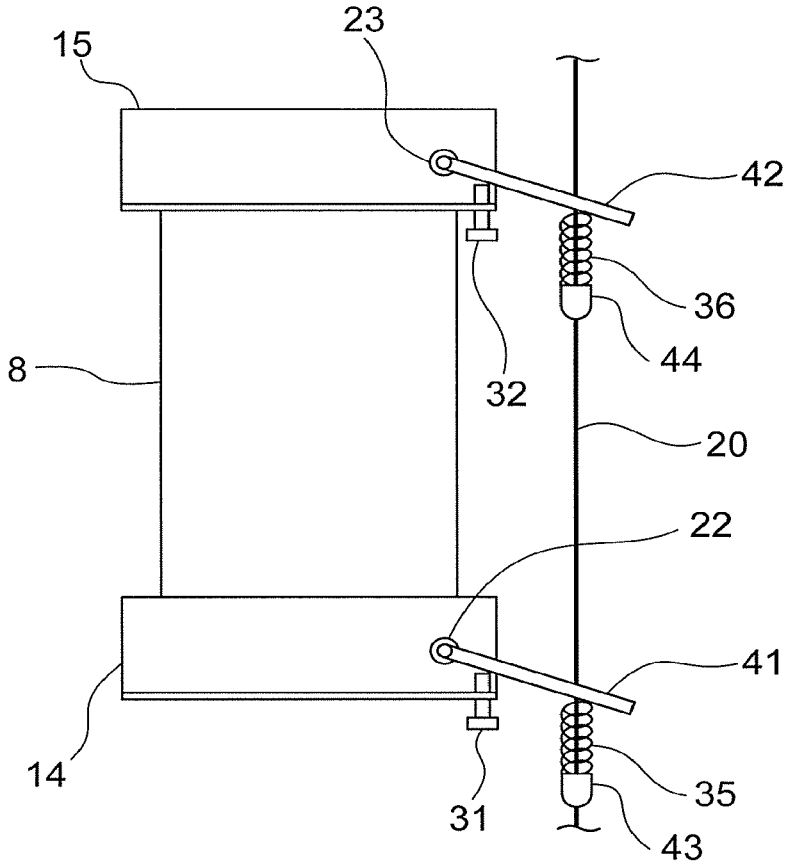
FIG. 7 is a front view showing a car of an elevator device according to a second embodiment of this invention.

FIG. 7 is a front view showing the car 8 of an elevator device according to a second embodiment of this invention. A lower portion pull-up lever 41 and an upper portion pull-up lever 42 according to the second embodiment are disposed so as to intersect the speed governor rope 20. More specifically, the speed governor rope 20 penetrates the lower portion pull-up lever 41 and the upper portion pull-up lever 42.

A lower portion rope fixing member (a block) 43 and an upper portion rope fixing member (a block) 44 are fixed to the speed governor rope 20. The upper portion rope fixing member 44 is fixed to the speed governor rope 20 above the lower portion rope fixing member 43. Horizontally projecting support arms are not provided on the rope fixing members 43, 44 according to the second embodiment.

The lower portion elastic body 35 is sandwiched between the lower portion rope fixing member 43 and the lower portion pull-up lever 41. The lower portion pull-up lever 41 is connected to the speed governor rope 20 via the lower portion elastic body 35 and the lower portion rope fixing member 43.

The upper portion elastic body 36 is sandwiched between the upper portion rope fixing member 44 and the upper portion pull-up lever 42. The upper portion pull-up lever 42 is connected to the speed governor rope 20 via the upper portion elastic body 36 and the upper portion rope fixing member 44. The lower portion pull-up lever 41 and the upper portion pull-up lever 42 are connected to the speed governor rope 20 in this manner so that the speed governor rope 20 moves together with the car 8 when the car 8 both ascends and descends (this point applies likewise to following embodiments). Further, the speed governor rope 20 penetrates the lower portion elastic body 35 and the upper portion elastic body 36.

Figure 8:
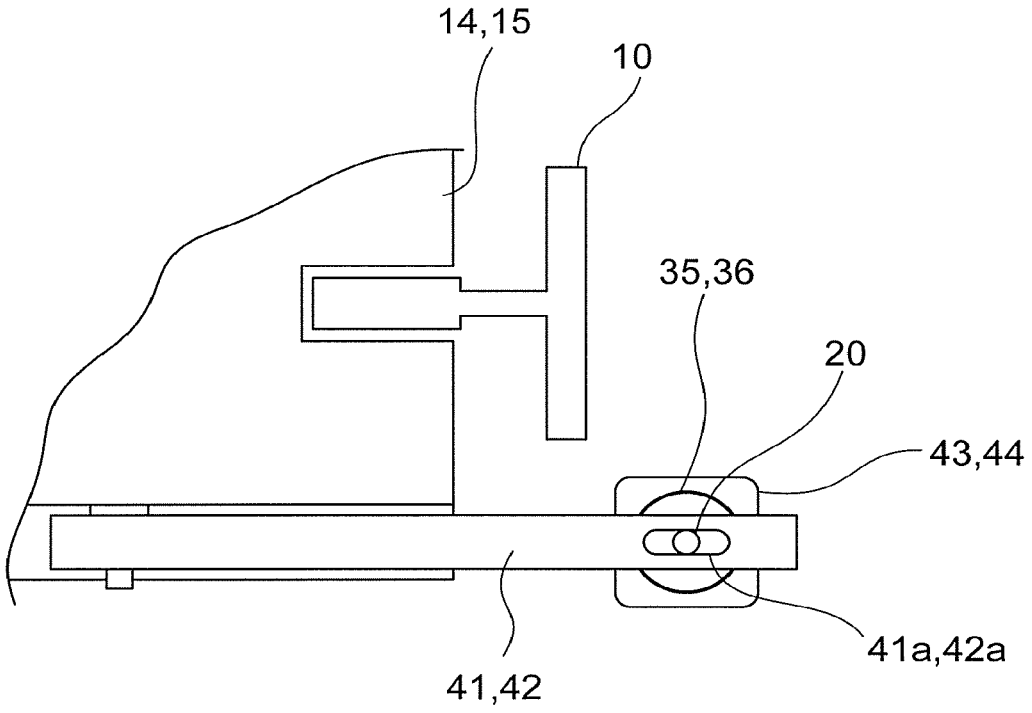
FIG. 8 is a plan view of a lower portion pull-up lever and an upper portion pull-up lever shown in FIG. 7.

FIG. 8 is a plan view of the lower portion pull-up lever 41 and the upper portion pull-up lever 42 shown in FIG. 7. A lower portion elongated hole 41*a* through which the speed governor rope 20 passes is provided in the lower portion pull-up lever 41. An upper portion elongated hole 42*a* through which the speed governor rope 20 passes is provided in the upper portion pull-up lever 42. As a result, only vertical direction movement is transmitted from the speed governor rope 20 to the pull-up levers 41, 42. All other configurations are similar or identical to that of the first embodiment.

Figure 9:
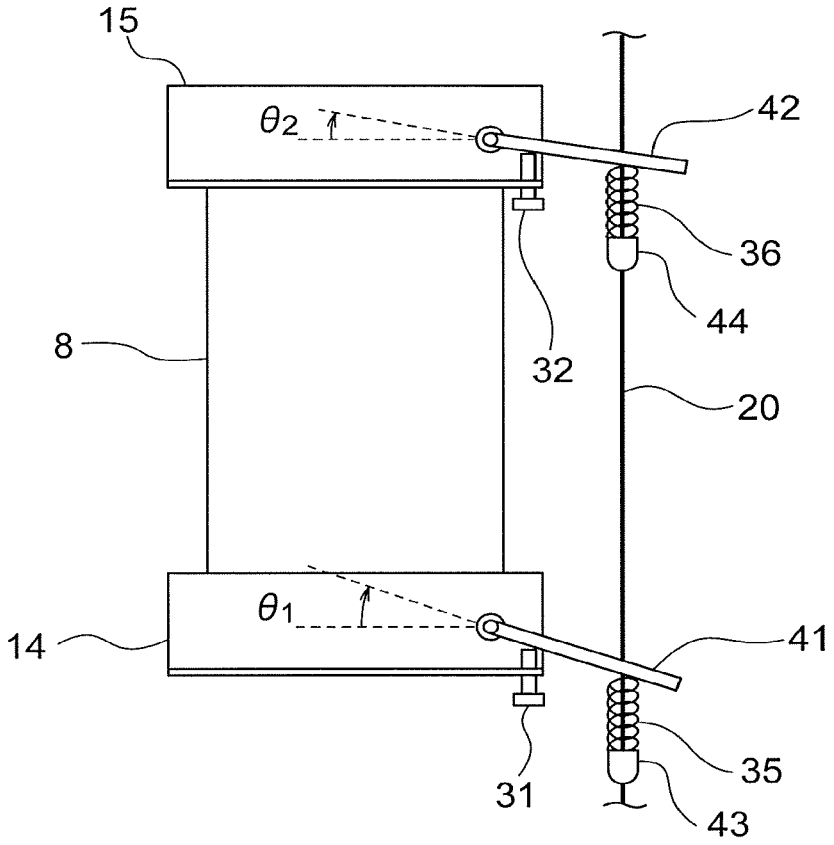
FIG. 9 is a front view showing a case in which initial angles of the lower portion pull-up lever and the upper portion pull-up lever of FIG. 7 are different.

FIG. 9 is a front view showing a case in which initial angles of the lower portion pull-up lever 41 and the upper portion pull-up lever 42 of FIG. 7 are different (i.e. a case in which a rotation stroke of the lower portion pull-up lever 41 required to activate the lower portion safety device 14 differs from a rotation stroke of the upper portion pull-up lever 42 required to activate the upper portion safety device 15). In this example, an initial angle $\theta 2$ of the upper portion pull-up lever 42 is set to be smaller than an initial angle $\theta 1$ of the lower portion pull-up lever 41 ($\theta 2<\theta 1$).

When the car 8 falls from the condition shown in FIG. 9 due to breakage of the suspending body 7 or the like such that the speed governor rope 20 is gripped, the lower portion pull-up lever 41 and the upper portion pull-up lever 42 are pulled up simultaneously. Since $\theta 2<\theta 1$, however, the upper portion pull-up lever 42 reaches the activation position first, as shown in FIG. 10.

At this time, the wedges 25*a*, 25*b* of the upper portion safety device 15 are wedged between the guide body 24 and the car guide rails 10, but the wedges 25*a*, 25*b* of the lower portion safety device 14 are not yet wedged. In a case where the elastic bodies 35, 36 are not provided, the lower portion pull-up lever 41 does not rotate any further, and therefore the lower portion safety device 14 is not activated. As a result, the safety devices 14, 15 as a whole cannot generate sufficient braking force.

Figure 10:
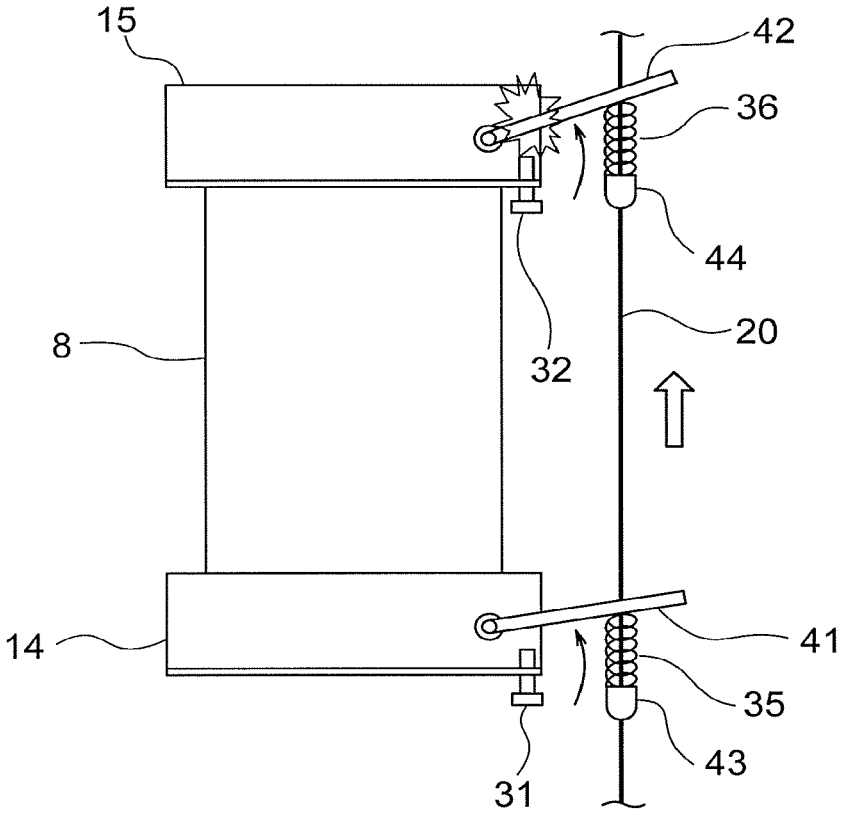
FIG. 10 is a front view showing a condition in which the upper portion pull-up lever of FIG. 9 has been rotated to an activation position.
Figure 11:
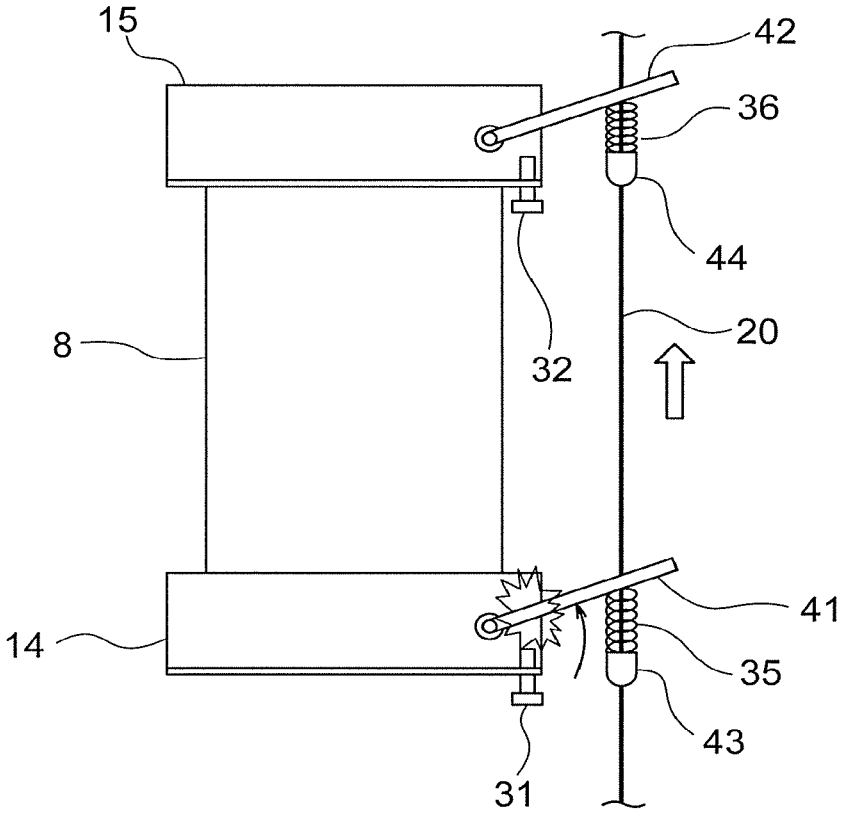
FIG. 11 is a front view showing a condition in which the lower portion pull-up lever of FIG. 10 has been rotated to an activation position.

When the elastic bodies 35, 36 are used, however, the upper portion elastic body 36 contracts from the condition shown in FIG. 10 such that the speed governor rope 20 moves further in an upward direction relative to the car 8 (the car 8 moves in a downward direction relative to the speed governor rope 20) within the elastic deformation range of the upper portion elastic body 36, and as a result, the lower portion pull-up lever 41 can be pulled up further. Accordingly, as shown in FIG. 11, the lower portion pull-up lever 41 can be rotated to the activation position following the upper portion pull-up lever 42.

Similarly to the first embodiment, therefore, the lower portion safety device 14 and the upper portion safety device 15 can be activated more reliably while improving the on-site work efficiency.

Moreover, in the first embodiment, the elastic bodies 35, 36 are disposed on the support arms 33*a*, 34*a*, and therefore a moment may be generated in the speed governor rope 20 during activation of the safety devices 14, 15, causing the speed governor rope 20 to deform in the vicinity of the rope fixing members 33, 34. In the second embodiment, on the other hand, only vertical direction force is exerted on the speed governor rope 20, and therefore the speed governor rope 20 is unlikely to deform during activation of the safety devices 14, 15. As a result, the safety devices 14, 15 can be activated more smoothly.

Furthermore, in the second embodiment, the elastic bodies 35, 36 are disposed coaxially with the speed governor rope 20, and therefore space can be saved in a horizontal direction.

Further, an identical component can be used for both the lower portion safety device 14 and the upper portion safety device 15.

Furthermore, an identical configuration can be applied to products in which the distance between the lower portion safety device 14 and the upper portion safety device 15 varies (i.e. design modifications are not required).

Third Embodiment

Figure 12:
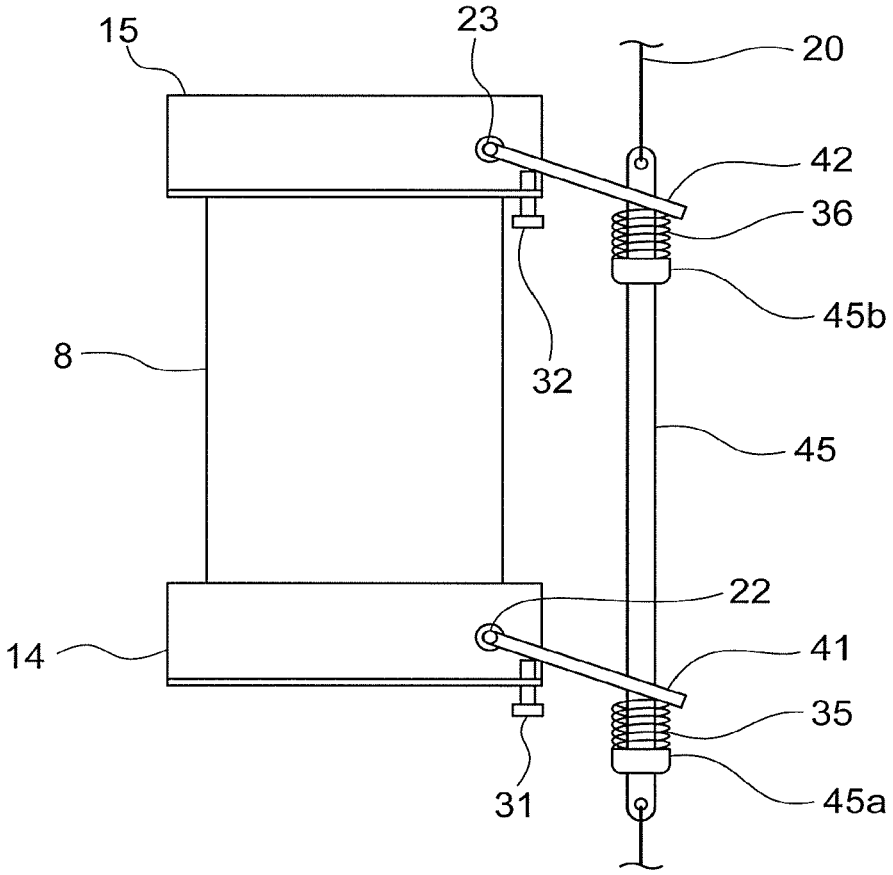
FIG. 12 is a front view showing a car of an elevator device according to a third embodiment of this invention.

FIG. 12 is a front view showing the car 8 of an elevator device according to a third embodiment of this invention. In the third embodiment, a connecting rod 45 is connected between respective end portions of the speed governor rope 20. The connecting rod 45 is formed from metal, for example. The connecting rod 45 is provided with a lower portion support portion 45*a* and an upper portion support portion 45*b*.

The lower portion support portion 45*a* is disposed below an intermediate portion of the connecting rod 45. The upper portion support portion 45*b* is disposed above the intermediate portion of the connecting rod 45.

The lower portion elastic body 35 is disposed on the lower portion support portion 45*a* so as to be sandwiched between the lower portion pull-up lever 41 and the lower portion support portion 45*a*. The lower portion pull-up lever 41 is connected to the speed governor rope 20 via the lower portion elastic body 35 and the connecting rod 45.

The upper portion elastic body 36 is disposed on the upper portion support portion 45*b* so as to be sandwiched between the upper portion pull-up lever 42 and the upper portion support portion 45*b*. The upper portion pull-up lever 42 is connected to the speed governor rope 20 via the upper portion elastic body 36 and the connecting rod 45. Further, the lower portion elastic body 35 and the upper portion elastic body 36 surround the connecting rod 45.

The connecting rod 45 is passed through the lower portion elongated hole 41*a* (FIG. 8) in the lower portion pull-up lever 41 and the upper portion elongated hole 42*a* (FIG. 8) in the upper portion pull-up lever 42. All other configurations are similar or identical to that of the second embodiment.

Figure 13:
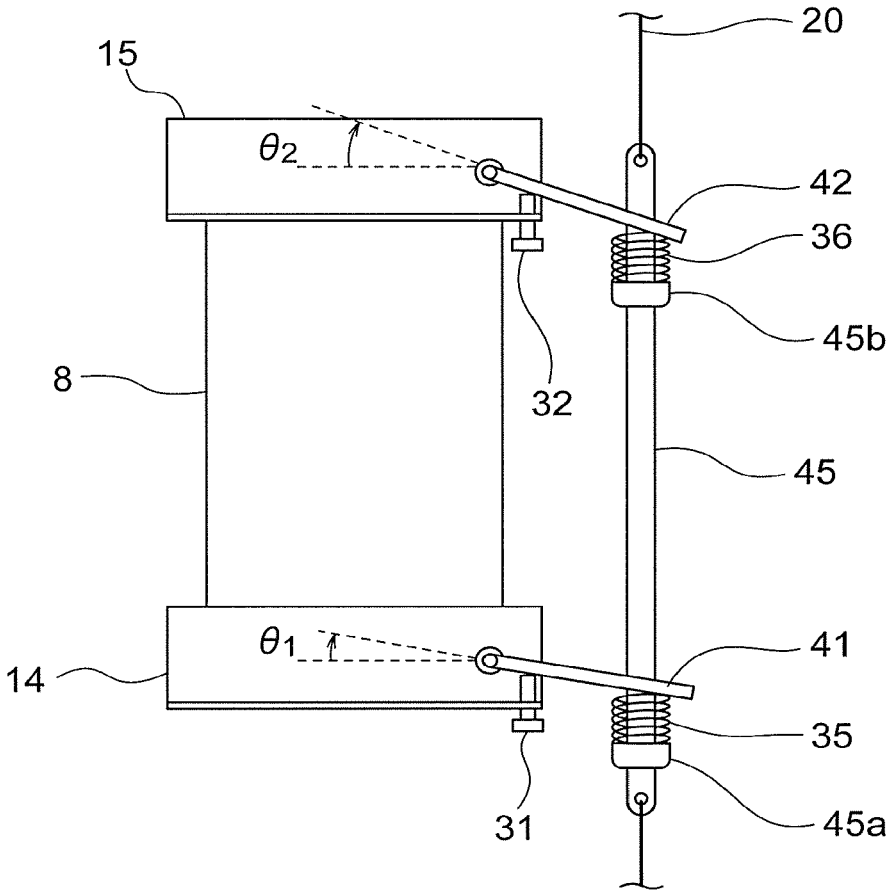
FIG. 13 is a front view showing a case in which the initial angles of a lower portion pull-up lever and an upper portion pull-up lever of FIG. 12 are different.

FIG. 13 is a front view showing a case in which the initial angles of the lower portion pull-up lever 41 and the upper portion pull-up lever 42 of FIG. 12 are different. In this example, the initial angle θ1 of the lower portion pull-up lever 41 is set to be smaller than the initial angle θ2 of the upper portion pull-up lever 42 (θ1<θ2).

When the car 8 falls from the condition shown in FIG. 13 due to breakage of the suspending body 7 or the like such that the speed governor rope 20 is gripped, the lower portion pull-up lever 41 and the upper portion pull-up lever 42 are pulled up simultaneously. Since θ1<θ2, however, the lower portion pull-up lever 41 reaches the activation position first, as shown in FIG. 14.

At this time, the wedges 25*a*, 25*b* of the lower portion safety device 14 are wedged between the guide body 24 and the car guide rails 10, but the wedges 25*a*, 25*b* of the upper portion safety device 15 are not yet wedged. In a case where the elastic bodies 35, 36 are not provided, the upper portion pull-up lever 42 does not rotate any further, and therefore the upper portion safety device 15 is not activated. As a result, the safety devices 14, 15 as a whole cannot generate sufficient braking force.

Figure 14:
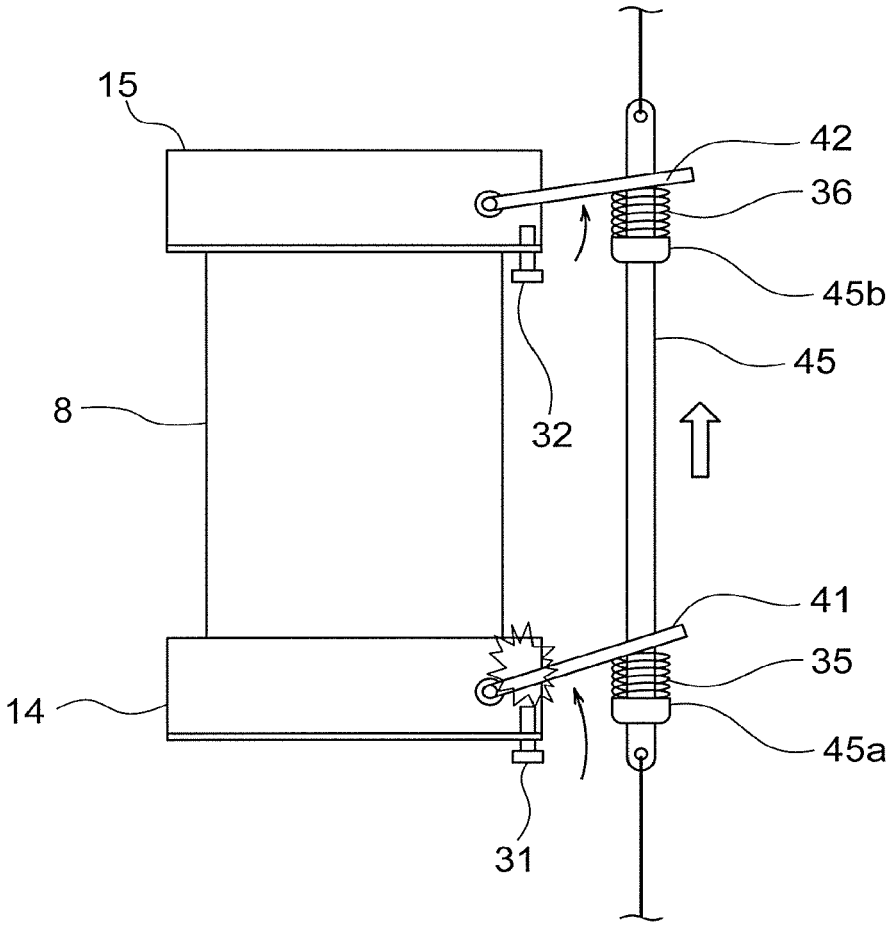
FIG. 14 is a front view showing a condition in which the lower portion pull-up lever of FIG. 13 has been rotated to the activation position.
Figure 15:
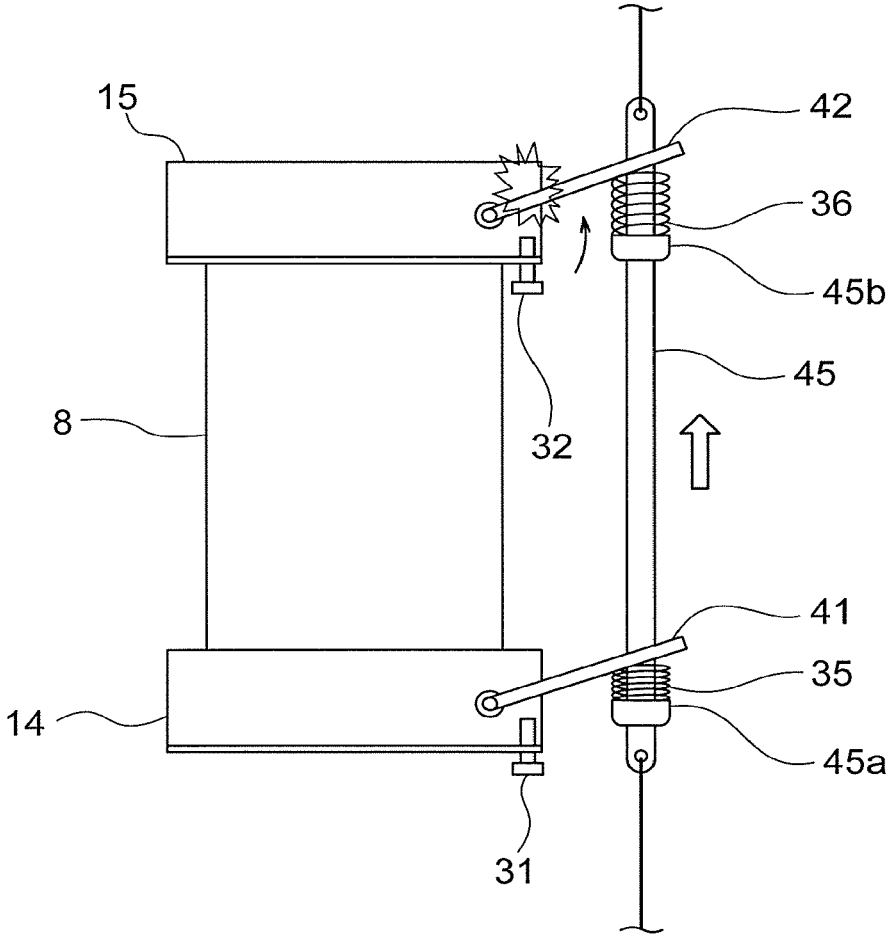
FIG. 15 is a front view showing a condition in which the upper portion pull-up lever of FIG. 14 has been rotated to the activation position.

When the elastic bodies 35, 36 are used, however, the lower portion elastic body 35 contracts from the condition shown in FIG. 14 such that the connecting rod 45 and the speed governor rope 20 move further in the upward direction relative to the car 8 within the elastic deformation range of the lower portion elastic body 35, and as a result, the upper portion pull-up lever 42 can be pulled up further. Accordingly, as shown in FIG. 15, the upper portion pull-up lever 42 can be rotated to the activation position following the lower portion pull-up lever 41.

Similarly to the first embodiment, therefore, the lower portion safety device 14 and the upper portion safety device 15 can be activated more reliably while improving the on-site work efficiency.

Moreover, by employing the connecting rod 45, an effect whereby damage to the speed governor rope 20 due to contact with the pull-up levers 41, 42 and the elastic bodies 35, 36 can be prevented, enabling an increase in the lifespan of the speed governor rope 20, can be obtained in addition to similar effects to the second embodiment.

Fourth Embodiment

Figure 16:
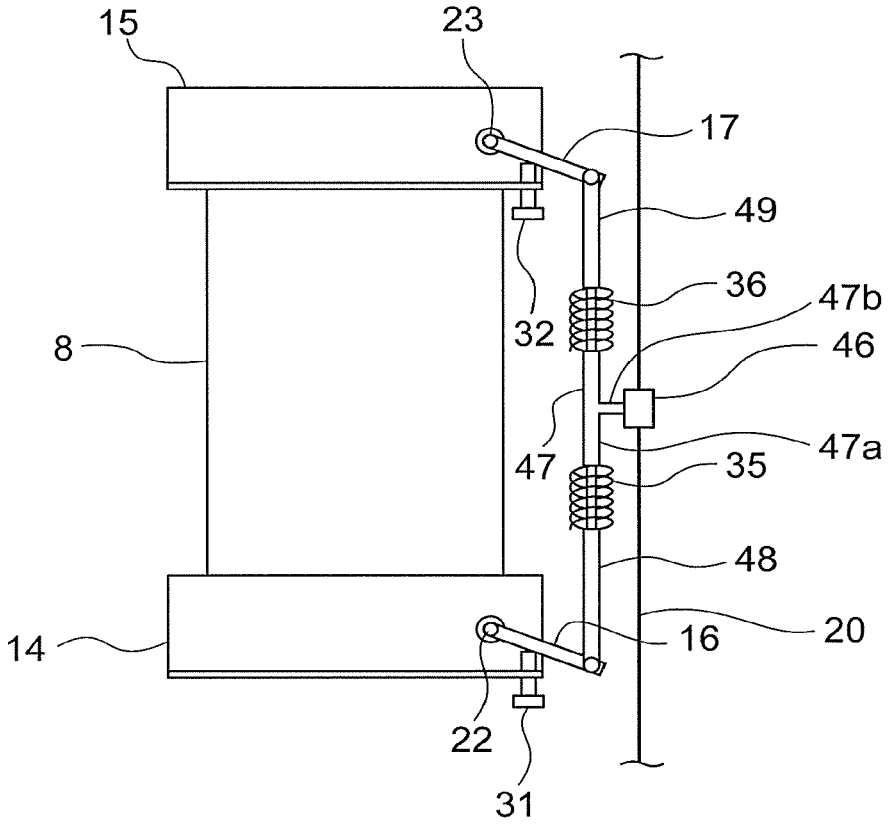
FIG. 16 is a front view showing a car of an elevator device according to a fourth embodiment of this invention.

FIG. 16 is a front view showing the car 8 of an elevator device according to a fourth embodiment of this invention. In the fourth embodiment, a rope fixing member (a block) 46 is fixed to the speed governor rope 20. An intermediate connecting member 47 is fixed to the rope fixing member 46. The intermediate connecting member 47 includes a rod portion 47*a* disposed parallel to the speed governor rope 20, and a projecting portion 47*b* that projects horizontally from an intermediate portion of the rod portion 47*a* and is connected to the rope fixing member 46.

A rod-shaped lower portion connecting member 48 is connected to the lower portion pull-up lever 16 to be free to rotate. The lower portion elastic body 35 is connected between the intermediate connecting member 47 and the lower portion connecting member 48. A rod-shaped upper portion connecting member 49 is connected to the upper portion pull-up lever 17 to be free to rotate. The upper portion elastic body 36 is connected between the intermediate connecting member 47 and the upper portion connecting member 49.

The lower portion pull-up lever 16 is connected to the speed governor rope 20 via the lower portion connecting member 48, the lower portion elastic body 35, and the intermediate connecting member 47. The upper portion pull-up lever 17 is connected to the speed governor rope 20 via the upper portion connecting member 49, the upper portion elastic body 36, and the intermediate connecting member 47.

The lower portion connecting member 48, the lower portion elastic body 35, the rod portion 47*a*, the upper portion elastic body 36, and the upper portion connecting member 49 are disposed so as to be arranged on a straight line parallel to the speed governor rope 20. All other configurations are similar or identical to that of the first embodiment.

Figure 17:
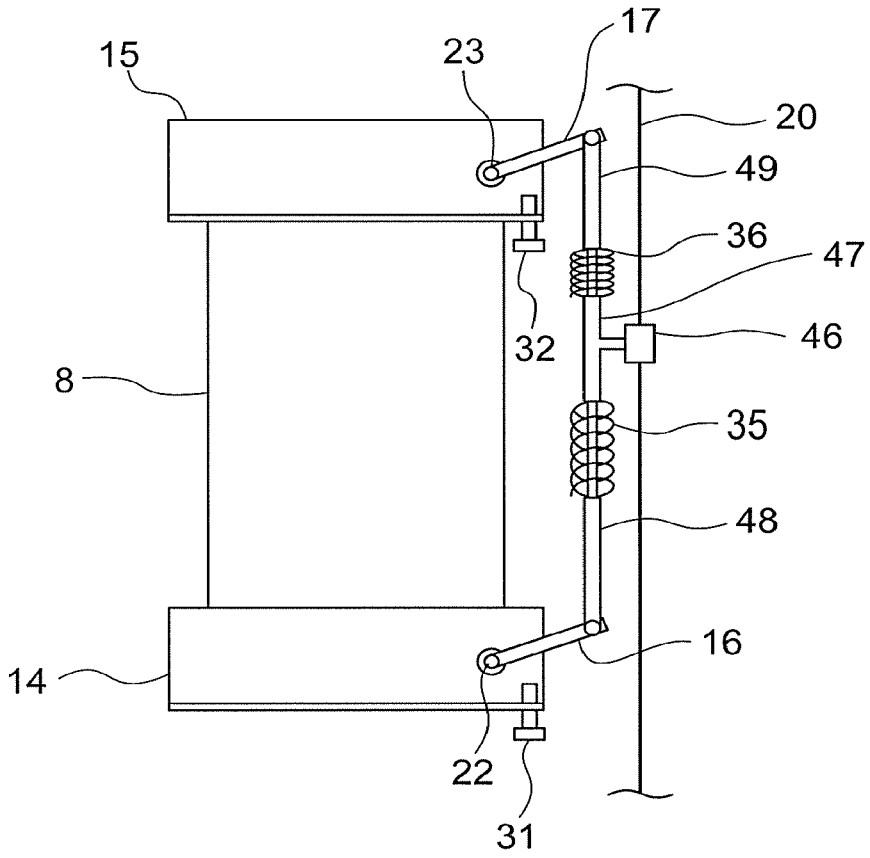
FIG. 17 is a front view showing a condition in which a lower portion safety device and an upper portion safety device of FIG. 16 are activated.

FIG. 17 is a front view showing a condition in which the lower portion safety device 14 and the upper portion safety device 15 of FIG. 16 are operative. According to the configuration of the fourth embodiment, when the lower portion elastic body 35 expands and the upper portion elastic body 36 contracts, the lower portion safety device 14 and the upper portion safety device 15 can both be activated even in a case where the initial angles of the lower portion pull-up lever 16 and the upper portion pull-up lever 17 are different.

Similarly to the first embodiment, therefore, the lower portion safety device 14 and the upper portion safety device 15 can be activated more reliably while improving the on-site work efficiency.

Moreover, a fixing portion fixed to the speed governor rope 20 is provided in only one location, making installation work less laborious.

Note that the rod portion 47*a* may be extended vertically so that the lower portion elastic body 35 is connected between a lower end portion of the rod portion 47*a* and the lower portion pull-up lever 16 and the upper portion elastic body 36 is connected between an upper end portion of the rod portion 47*a* and the upper portion pull-up lever 17. In so doing, the lower portion connecting member 48 and the upper portion connecting member 49 can be omitted.

Fifth Embodiment

Figure 18:
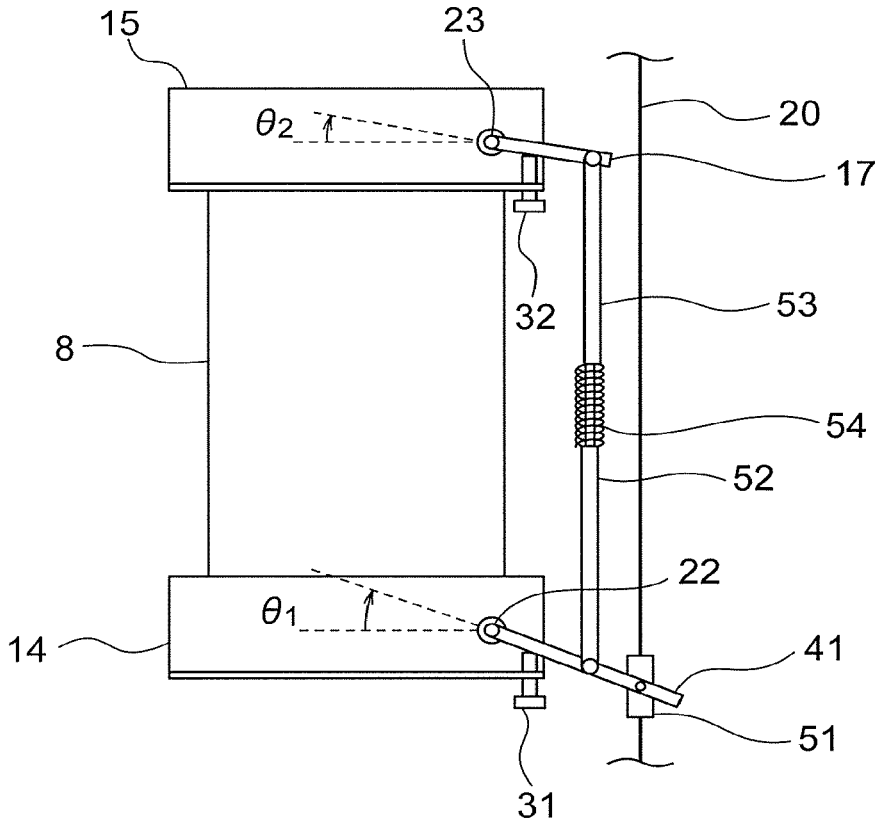
FIG. 18 is a front view showing a car of an elevator device according to a fifth embodiment of this invention.

FIG. 18 is a front view showing the car 8 of an elevator device according to a fifth embodiment of this invention. A rope fixing member (a block) 51 is fixed to the speed governor rope 20. The lower portion pull-up lever 41 is connected to the rope fixing member 51 to be free to rotate.

The speed governor rope 20 is passed through the lower portion elongated hole 41*a* (FIG. 8) in the lower portion pull-up lever 41.

A lower end portion of a rod-shaped lower portion connecting member 52 is connected to an intermediate portion of the lower portion pull-up lever 41 to be free to rotate. An upper end portion of a rod-shaped upper portion connecting member 53 is connected to the upper portion pull-up lever 17 to be free to rotate. An elastic body 54 is connected between an upper end portion of the lower portion connecting member 52 and a lower end portion of the upper portion connecting member 53 to be capable of expanding and contracting in the vertical direction.

The lower portion pull-up lever 41 is connected to the speed governor rope 20 via the rope fixing member 51. The upper portion pull-up lever 17 is connected to the speed governor rope 20 via the upper portion connecting member 53, the elastic body 54, the lower portion connecting member 52, the lower portion pull-up lever 41, and the rope fixing member 51. In other words, in the fifth embodiment, the elastic body 54 is provided between the upper portion pull-up lever 17 and the speed governor rope 20.

A difference is provided between the initial angles of the lower portion pull-up lever 41 and the upper portion pull-up lever 17 in advance in a factory. In other words, a difference is provided in advance between the rotation stroke of the lower portion pull-up lever 41 required to activate the lower portion safety device 14 and the rotation stroke of the upper portion pull-up lever required to activate the upper portion safety device 15. In the fifth embodiment, the initial angle $\theta 2$ of the upper portion pull-up lever 17 is set to be smaller than the initial angle $\theta 1$ of the lower portion pull-up lever 41 ($\theta 2<\theta 1$).

The elastic body 54 is sufficiently rigid to withstand a force for pulling up the lower portion pull-up lever 41 and the upper portion pull-up lever 17, and does not therefore deform elastically in response to a force for wedging the wedges 25*a*, 25*b* completely between the guide body 24 and the car guide rails 10 in order to activate the lower portion safety device 14 and the upper portion safety device 15.

In a condition where only one of the lower portion safety device 14 and the upper portion safety device 15 (in the fifth embodiment, the upper portion safety device 15) is activated when the car 8 falls, however, the elastic body 54 deforms elastically in response to a force for causing the car 8 to fall further relative to the speed governor rope 20. All other configurations are similar or identical to that of the first embodiment.

Figure 19:
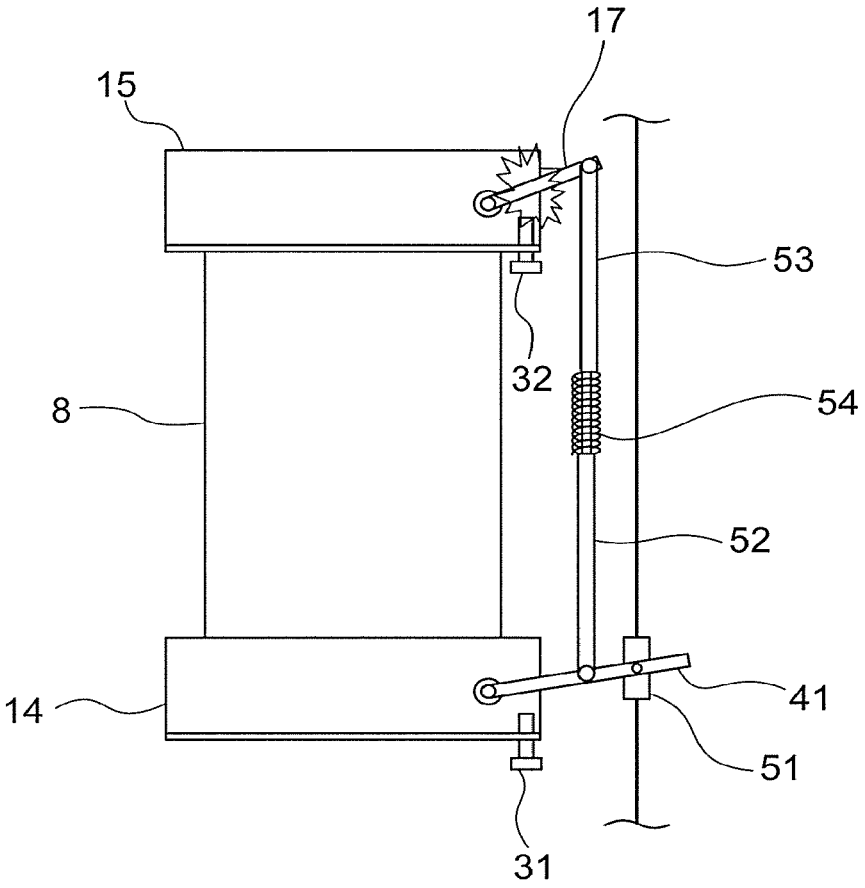
FIG. 19 is a front view showing a condition in which an upper portion pull-up lever of FIG. 18 has been rotated to the activation position.

When the car 8 falls from the condition shown in FIG. 18 due to breakage of the suspending body 7 or the like such that the speed governor rope 20 is gripped, the lower portion pull-up lever 41 and the upper portion pull-up lever 17 are pulled up simultaneously. Since $\theta 2<\theta 1$, however, the upper portion pull-up lever 17 reaches the activation position first, as shown in FIG. 19.

At this time, the wedges 25*a*, 25*b* of the upper portion safety device 15 are wedged between the guide body 24 and the car guide rails 10, but the wedges 25*a*, 25*b* of the lower portion safety device 14 are not yet wedged.

Figure 20:
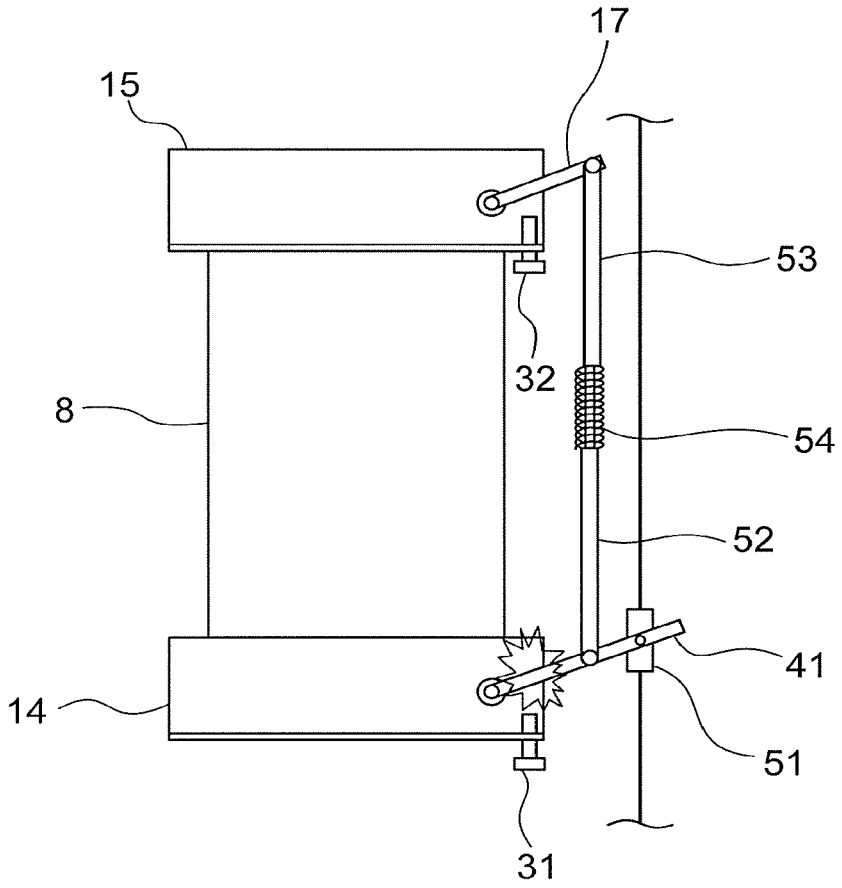
FIG. 20 is a front view showing a condition in which a lower portion pull-up lever of FIG. 19 has been rotated to the activation position.

When the elastic body 54 then contracts, the speed governor rope 20 moves further in the upward direction relative to the car 8 (the car 8 moves in the downward direction relative to the speed governor rope 20) within the elastic deformation range of the elastic body 54, and as a result, the lower portion pull-up lever 41 can be pulled up further. Accordingly, as shown in FIG. 20, the lower portion pull-up lever 41 can be rotated to the activation position following the upper portion pull-up lever 17.

Similarly to the first embodiment, therefore, the lower portion safety device 14 and the upper portion safety device 15 can be activated more reliably while improving the on-site work efficiency.

Further, since a difference is provided in advance between the initial angles of the lower portion pull-up lever 41 and the upper portion pull-up lever 17, only the single elastic body 54 is required.

Furthermore, the speed governor rope 20 is unlikely to deform during activation of the safety devices 14, 15, and therefore the safety devices 14, 15 can be activated more smoothly.

Moreover, a fixing portion fixed to the speed governor rope 20 is provided in only one location, making installation work less laborious.

Note that one of the lower portion connecting member 52 and the upper portion connecting member 53 may be omitted so that the elastic body 54 is connected directly to either the lower portion pull-up lever 41 or the upper portion pull-up lever 17.

Sixth Embodiment

Figure 21:
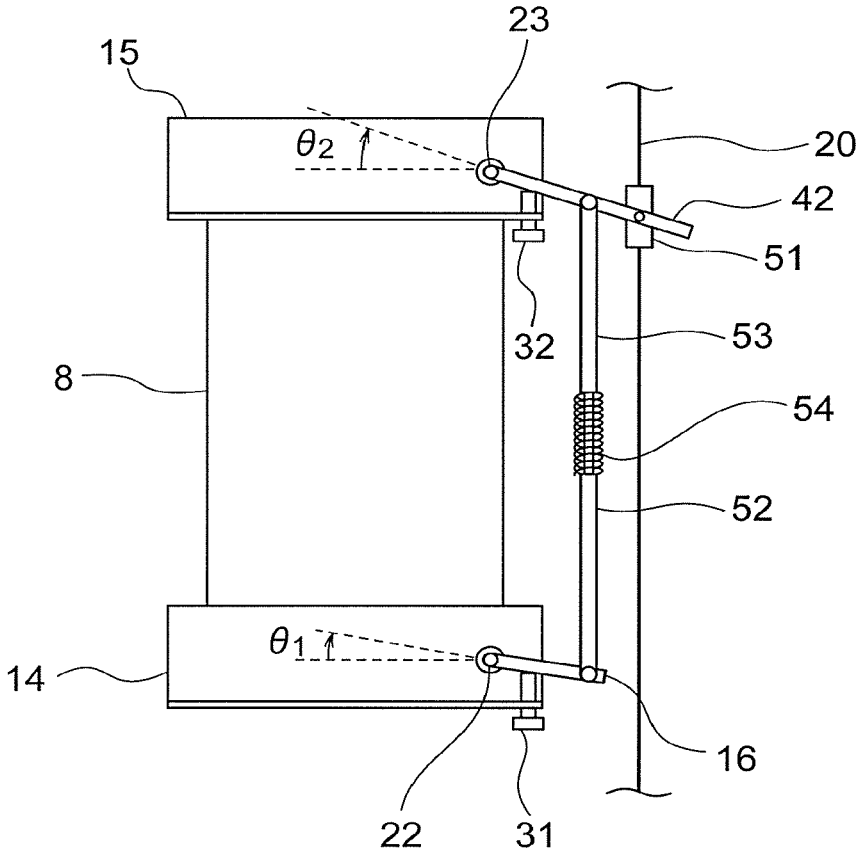
FIG. 21 is a front view showing a car of an elevator device according to a sixth embodiment of this invention.

FIG. 21 is a front view showing the car 8 of an elevator device according to a sixth embodiment of this invention. The upper portion pull-up lever 42 is connected to the rope fixing member 51 to be free to rotate. The speed governor rope 20 is passed through the upper portion elongated hole 42*a* in the upper portion pull-up lever 42.

The lower end portion of the rod-shaped lower portion connecting member 52 is connected to the lower portion pull-up lever 16 to be free to rotate. The upper end portion of the rod-shaped upper portion connecting member 53 is connected to an intermediate portion of the upper portion pull-up lever 42 to be free to rotate.

The upper portion pull-up lever 42 is connected to the speed governor rope 20 via the fixing member 51. The lower portion pull-up lever 16 is connected to the speed governor rope 20 via the lower portion connecting member 52, the elastic body 54, the upper portion connecting member 53, the upper portion pull-up lever 42, and the rope fixing member 51. In other words, in the sixth embodiment, the elastic body 54 is provided between the lower portion pull-up lever 16 and the speed governor rope 20.

In the sixth embodiment, the initial angle $\theta 1$ of the lower portion pull-up lever 16 is set to be smaller than the initial angle $\theta 2$ of the upper portion pull-up lever 42 ($\theta 1<\theta 2$). All other configurations are similar or identical to that of the fifth embodiment.

With this configuration, similar effects to the fifth embodiment can be obtained.

Moreover, a tensile load does not act on the lower portion connecting member 52 and the upper portion connecting member 53 alone, and therefore the connecting members 52, 53 can be reduced in strength. As a result, the connecting members 52, 53 can be designed more easily and reduced in cost.

Seventh Embodiment

Figure 22:
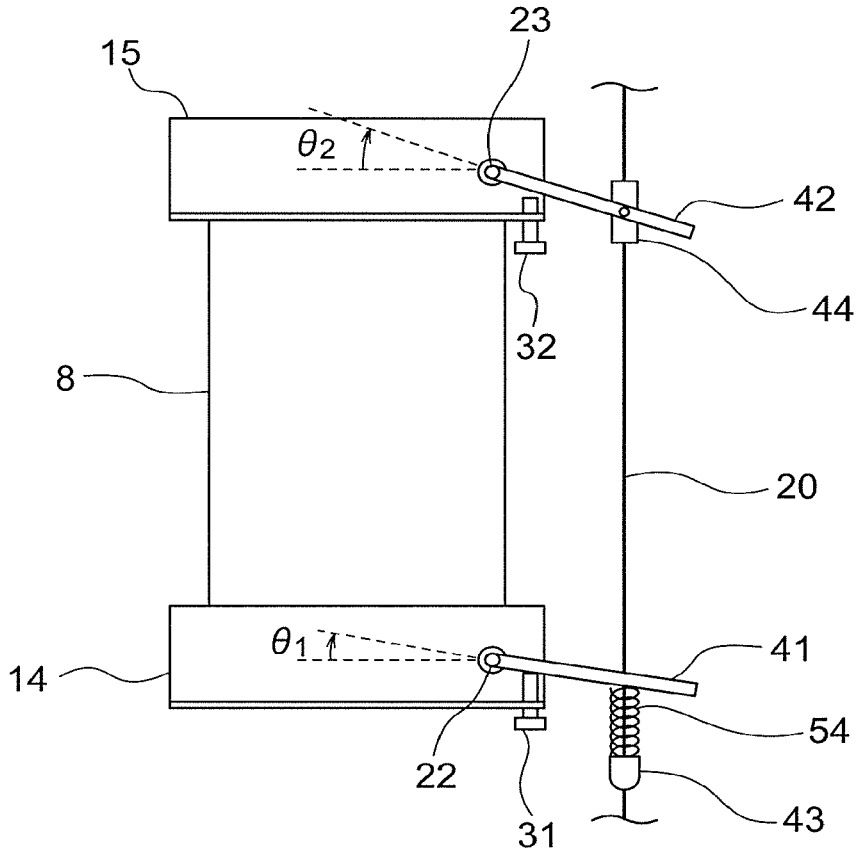
FIG. 22 is a front view showing a car of an elevator device according to a seventh embodiment of this invention.

FIG. 22 is a front view showing the car 8 of an elevator device according to a seventh embodiment of this invention. A lower portion rope fixing member 43 and an upper portion rope fixing member 44 are fixed to the speed governor rope 20 respectively as a lower portion support portion, i.e. a support portion corresponding to the lower portion pull-up lever 41, and an upper portion support portion, i.e. a support portion corresponding to the upper portion pull-up lever 42.

The elastic body 54 surrounds the speed governor rope 20, and is sandwiched between the lower portion rope fixing member 43 and the lower portion pull-up lever 41. The lower portion pull-up lever 41 is connected to the speed governor rope 20 via the elastic body 54 and the lower portion rope fixing member 43. In other words, in the seventh embodiment, the elastic body 54 is provided between the lower portion pull-up lever 41 and the speed governor rope 20.

The upper portion pull-up lever 42 is connected to the upper portion rope fixing member 44 to be free to rotate. Further, the upper portion pull-up lever 42 is connected to the speed governor rope 20 via the upper portion rope fixing member 44. All other configurations are similar or identical to that of the sixth embodiment.

Hence, the seventh embodiment is realized by omitting the upper portion elastic body 36 from the configuration of the second embodiment, and making the initial angle θ1 of the lower portion pull-up lever 41 smaller than the initial angle θ2 of the upper portion pull-up lever 42 (θ1<θ2).

Figure 23:
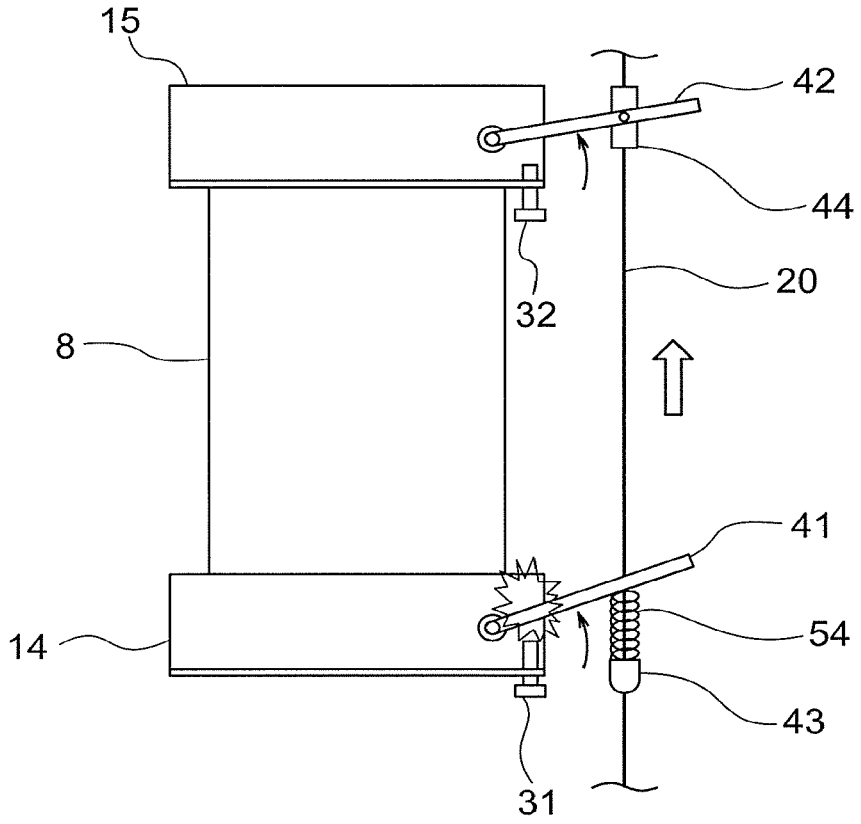
FIG. 23 is a front view showing a condition in which a lower portion pull-up lever of FIG. 22 has been rotated to the activation position.

When the car 8 falls from the condition shown in FIG. 22 due to breakage of the suspending body 7 or the like such that the speed governor rope 20 is gripped, the lower portion pull-up lever 41 and the upper portion pull-up lever 42 are pulled up simultaneously. Since θ1<θ2, however, the lower portion pull-up lever 41 reaches the activation position first, as shown in FIG. 23.

At this time, the wedges 25*a*, 25*b* of the lower portion safety device 14 are wedged between the guide body 24 and the car guide rails 10, but the wedges 25*a*, 25*b* of the upper portion safety device 15 are not yet wedged.

Figure 24:
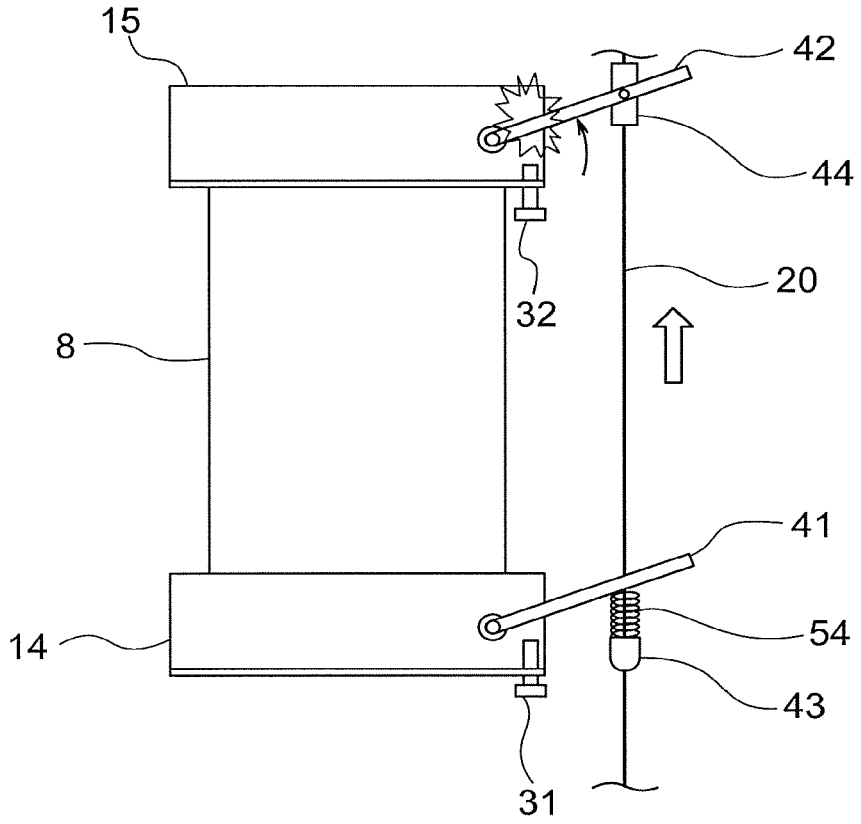
FIG. 24 is a front view showing a condition in which an upper portion pull-up lever of FIG. 23 has been rotated to the activation position.

When the elastic body 54 then contracts, the speed governor rope 20 moves further in the upward direction relative to the car 8 (the car 8 moves in the downward direction relative to the speed governor rope 20) within the elastic deformation range of the elastic body 54, and as a result, the upper portion pull-up lever 42 can be pulled up further. Accordingly, as shown in FIG. 24, the upper portion pull-up lever 42 can be rotated to the activation position following the lower portion pull-up lever 41.

Similarly to the first embodiment, therefore, the lower portion safety device 14 and the upper portion safety device 15 can be activated more reliably while improving the on-site work efficiency.

Furthermore, similarly to the second embodiment, the speed governor rope 20 is unlikely to deform, and therefore space can be saved in the horizontal direction. Moreover, an identical configuration can be applied to products in which the distance between the lower portion safety device 14 and the upper portion safety device 15 varies (i.e. design modifications are not required).

Further, since a difference is provided in advance between the initial angles of the lower portion pull-up lever 41 and the upper portion pull-up lever 42, only the single elastic body 54 is required, and therefore reductions in cost and weight can be achieved.

Eighth Embodiment

Figure 25:
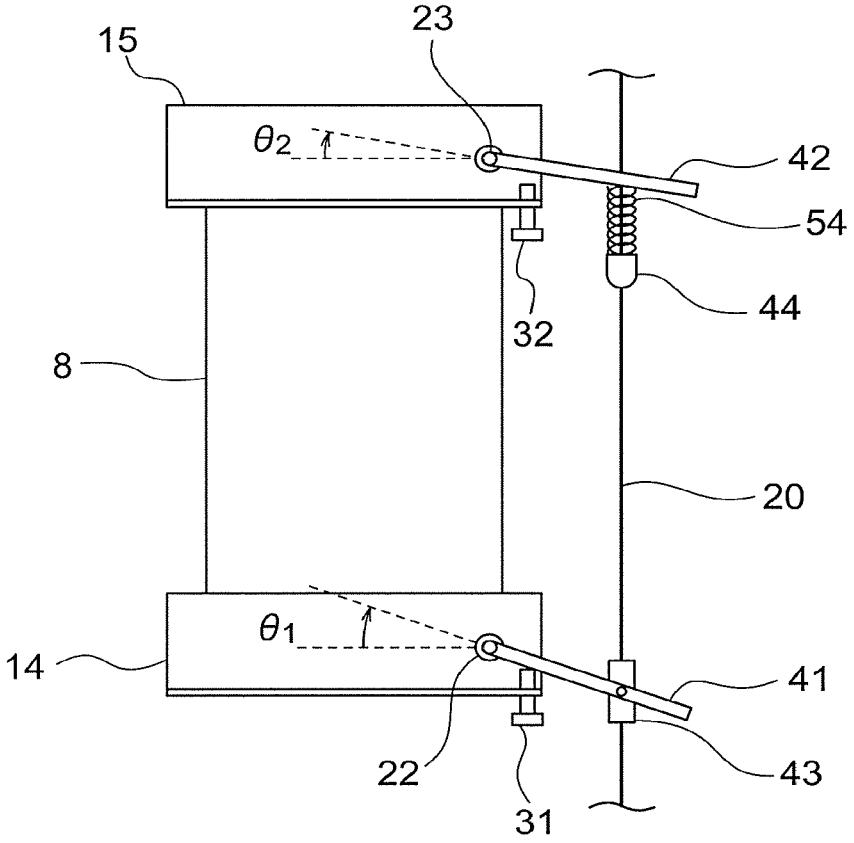
FIG. 25 is a front view showing a car of an elevator device according to an eighth embodiment of this invention.

FIG. 25 is a front view showing the car 8 of an elevator device according to an eighth embodiment of this invention. In the eighth embodiment, the elastic body 54 of the seventh embodiment is disposed between the upper portion rope fixing member 44 and the upper portion pull-up lever 42, the lower portion pull-up lever 41 is connected to the lower portion rope fixing member 43 to be free to rotate, and the initial angle θ2 of the upper portion pull-up lever 42 is set to be smaller than the initial angle θ1 of the lower portion pull-up lever (θ2<θ1). In other words, in the eighth embodiment, the elastic body 54 is provided between the upper portion pull-up lever 42 and the speed governor rope 20. All other configurations are similar or identical to that of the seventh embodiment.

With this configuration, similar effects to the seventh embodiment can be obtained.

Ninth Embodiment

Figure 26:
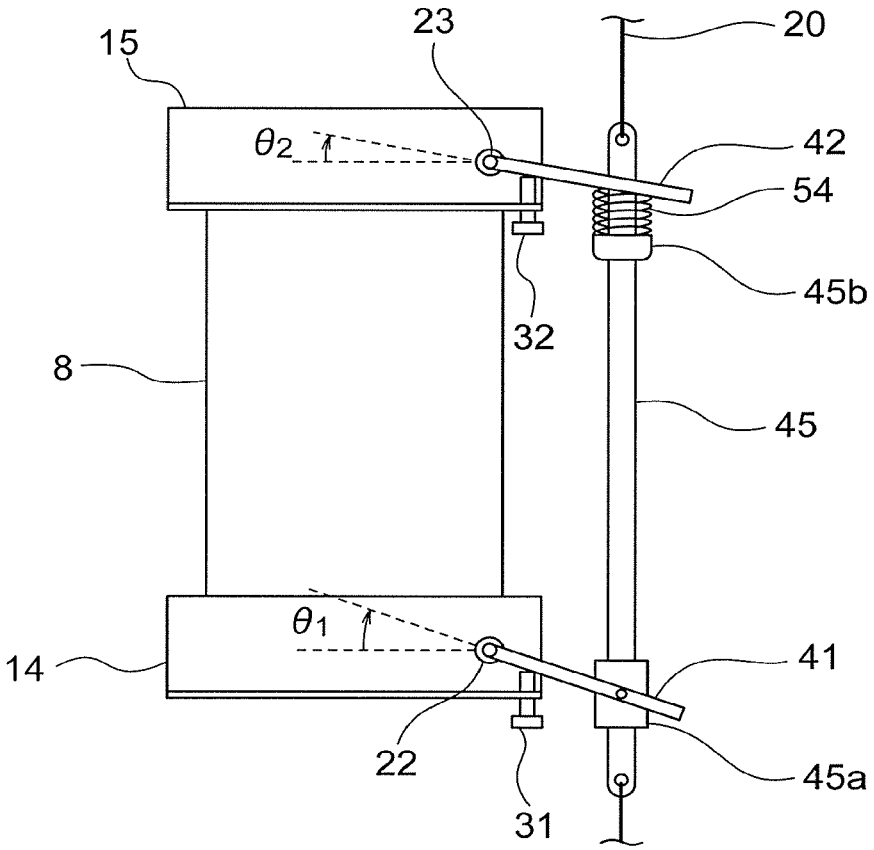
FIG. 26 is a front view showing a car of an elevator device according to a ninth embodiment of this invention.

FIG. 26 is a front view showing the car 8 of an elevator device according to a ninth embodiment of this invention. In the ninth embodiment, the connecting rod 45 is connected between the respective end portions of the speed governor rope 20. The elastic body 54 is disposed on the upper portion support portion 45*b* so as to be sandwiched between the upper portion support portion 45*b* and the upper portion pull-up lever 42. The lower portion pull-up lever 41 is connected to the lower portion support portion 45*a* to be free to rotate.

The lower portion pull-up lever 41 is connected to the speed governor rope 20 via the connecting rod 45. The upper portion pull-up lever 42 is connected to the speed governor rope 20 via the elastic body 54 and the connecting rod 45. In other words, in the ninth embodiment, the elastic body 54 is provided between the upper portion pull-up lever 42 and the speed governor rope 20.

The initial angle θ2 of the upper portion pull-up lever 42 is set to be smaller than the initial angle θ1 of the lower portion pull-up lever 41 (θ2<θ1). All other configurations are similar or identical to that of the first embodiment.

Hence, the ninth embodiment is realized by omitting the lower portion elastic body 35 from the configuration of the third embodiment (FIG. 12), and making the initial angle θ2 of the upper portion pull-up lever 42 smaller than the initial angle θ1 of the lower portion pull-up lever 41.

Likewise with this configuration, similarly to the first embodiment, the lower portion safety device 14 and the upper portion safety device 15 can be activated more reliably while improving the on-site work efficiency.

Further, similarly to the third embodiment, by employing the connecting rod 45, damage to the speed governor rope 20 due to contact with the pull-up levers 41, 42 and the elastic body 54 can be prevented, enabling an increase in the lifespan of the speed governor rope 20.

Tenth Embodiment

Figure 27:
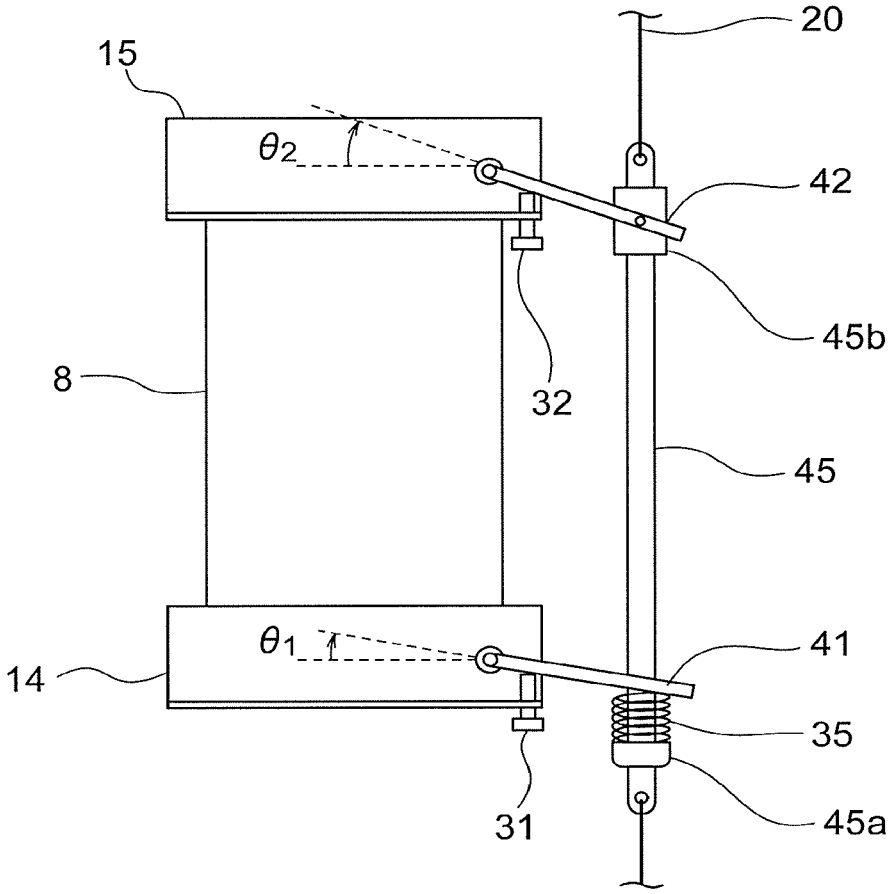
FIG. 27 is a front view showing a car of an elevator device according to a tenth embodiment of this invention.

FIG. 27 is a front view showing the car 8 of an elevator device according to a tenth embodiment of this invention. In the tenth embodiment, the elastic body 54 is disposed on the lower portion support portion 45*a* so as to be sandwiched between the lower portion support portion 45*a* and the lower portion pull-up lever 41. The upper portion pull-up lever 42 is connected to the upper portion support portion 45*b* to be free to rotate.

The upper portion pull-up lever 42 is connected to the speed governor rope 20 via the connecting rod 45. The lower portion pull-up lever 41 is connected to the speed governor rope 20 via the elastic body 54 and the connecting rod 45. In other words, in the tenth embodiment, the elastic body 54 is provided between the lower portion pull-up lever 41 and the speed governor rope 20.

The initial angle θ1 of the lower portion pull-up lever 41 is set to be smaller than the initial angle θ2 of the upper portion pull-up lever 42 (θ1<θ2). All other configurations are similar or identical to that of the ninth embodiment.

With this configuration, similar effects to the ninth embodiment can be obtained.

Note that to facilitate description of the drawings, cases in which the initial angles θ1, θ2 are different were envisaged in the examples described above. In actuality, however, individual differences (including irregularities) exist in the relationship between the pullup levers and the wedges, and therefore the ascent distance e of the wedges may differ between the upper and lower safety devices even when the initial angles are identical. This invention is capable of responding sufficiently to such a case.

Further, the ascending/descending body may be the counter weight. In other words, this invention can also be applied to a case in which safety devices are installed in the upper and lower portions of the counter weight.

Furthermore, the overall device layout, roping method, and so on of the elevator device are not limited to the example shown in FIG. 1. For example, this invention may also be applied to an elevator device with two to one roping. The position, number, and so on of the hoisting machine, for example, are likewise not limited to the example shown in FIG. 1.

Moreover, this invention may be applied to various types of elevator devices, such as a machine-roomless elevator, a double-deck elevator, or a one-shaft multi-car type elevator, for example.

The invention claimed is:

1. An elevator device comprising:

an ascending/descending body;

a lower portion safety device installed in a lower portion of the ascending/descending body;

an upper portion safety device installed in an upper portion of the ascending/descending body;

a speed governor rope that extends through a hoistway and performs a circulatory motion as the ascending/descending body ascends and descends;

a lower portion pull-up lever that is disposed at the lower portion safety device and activates the lower portion safety device when pulled up by the speed governor rope, the lower portion pull-up lever having two longitudinal ends, a first longitudinal end of the two longitudinal ends of the lower portion pull-up lever being pivotally attached to the lower portion safety device, and a second longitudinal end of the two longitudinal ends of the lower portion pull-up lever being free, except for a connection which links to a lower portion elastic body;

an upper portion pull-up lever that is disposed at the upper portion safety device and activates the upper portion safety device when pulled up by the speed governor rope, the upper portion pull-up lever having two longitudinal ends, a first longitudinal end of the two longitudinal ends of the upper portion pull-up lever being pivotally attached to the upper portion safety device, and a second longitudinal end of the two longitudinal ends of the upper portion pull-up lever being free, except for a connection which links to an upper portion elastic body; and a speed governor that monitors the ascending/descending body for travel at an excessive speed, and activates the lower portion safety device and the upper portion safety device by gripping the speed governor rope when a travel speed of the ascending/descending body reaches the excessive speed, wherein:

a lower portion rope fixing member and an upper portion rope fixing member are fixed to the speed governor rope, the lower portion elastic body is disposed between the lower portion rope fixing member and the lower portion pull-up lever, and the upper portion elastic body is disposed between the upper portion rope fixing member and the upper portion pull-up lever.

2. The elevator device according to claim 1, wherein a lower portion elongated hole is disposed in the lower portion pull-up lever, an upper portion elongated hole is disposed in the upper portion pull-up lever, and the speed governor rope is passed through the lower portion elongated hole and the upper portion elongated hole.

3. An elevator device comprising:

an ascending/descending body;

a lower portion safety device installed in a lower portion of the ascending/descending body;

an upper portion safety device installed in an upper portion of the ascending/descending body;

a speed governor rope that extends through a hoistway and performs a circulatory motion as the ascending/descending body ascends and descends;

a lower portion pull-up lever that is disposed at the lower portion safety device and activates the lower portion safety device when pulled up by the speed governor rope;

an upper portion pull-up lever that is disposed at the upper portion safety device and activates the upper portion safety device when pulled up by the speed governor rope; and a speed governor that monitors the ascending/descending body for travel at an excessive speed, and activates the lower portion safety device and the upper portion safety device by gripping the speed governor rope when a travel speed of the ascending/descending body reaches the excessive speed, wherein:

a lower portion rope fixing member and an upper portion rope fixing member are fixed to the speed governor rope, a lower portion elastic body is disposed between the lower portion rope fixing member and the lower portion pull-up lever, an upper portion elastic body is disposed between the upper portion rope fixing member and the upper portion pull-up lever, a lower portion support arm is disposed on the lower portion rope fixing member, an upper portion support arm is disposed on the upper portion rope fixing member, the lower portion elastic body is disposed between the lower portion support arm and the lower portion pull-up lever, and the upper portion elastic body is disposed between the upper portion support arm and the upper portion pull-up lever.

4. The elevator device according to claim 3, wherein:

the lower portion pull-up lever has two longitudinal ends, a first longitudinal end of the two longitudinal ends of the lower portion pull-up lever being pivotally attached to the lower portion safety device, and a second longitudinal end of the two longitudinal ends of the lower portion pull-up lever being free, except for a connection which links to the lower portion elastic body, and the upper portion pull-up lever has two longitudinal ends, a first longitudinal end of the two longitudinal ends of the upper portion pull-up lever being pivotally attached to the upper portion safety device, and a second longitudinal end of the two longitudinal ends of the upper portion pull-up lever being free, except for a connection which links to the upper portion elastic body.

* * * * *